US008204692B2

(12) United States Patent
Arango et al.

(10) Patent No.: US 8,204,692 B2
(45) Date of Patent: Jun. 19, 2012

(54) SYSTEM, PROGRAM PRODUCT, AND METHOD FOR DRILLING RIG ACTIVITY ACCOUNTING VISUALIZATION

(75) Inventors: Guillermo Arango, Bellaire, TX (US); Wesley C. Vestal, Houston, TX (US); Daniel D. Blue, III, Houston, TX (US); Andreas Sadlier, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 208 days.

(21) Appl. No.: 12/523,713

(22) PCT Filed: Dec. 18, 2007

(86) PCT No.: PCT/US2007/025807

§ 371 (c)(1),
(2), (4) Date: Jul. 17, 2009

(87) PCT Pub. No.: WO2008/076426

PCT Pub. Date: Jun. 26, 2008

(65) Prior Publication Data

US 2010/0114493 A1 May 6, 2010

Related U.S. Application Data

(60) Provisional application No. 60/875,442, filed on Dec. 18, 2006.

(51) Int. Cl.

| | |
|---|---|
| ***G01V 9/00*** | (2006.01) |
| ***G01V 3/38*** | (2006.01) |
| ***G01V 3/00*** | (2006.01) |
| ***G06F 11/00*** | (2006.01) |
| ***H04B 7/24*** | (2006.01) |

(52) U.S. Cl. ..... 702/9; 702/5; 702/188; 340/853.2; 455/507

(58) Field of Classification Search ..... 702/185, 702/188, 6–13, 34–35, 81–84, 113–114, 702/182–183; 340/853.1, 853.2; 700/79–80, 700/108–110; 455/3.01–3.04, 507–508
See application file for complete search history.

(56) References Cited

U.S. PATENT DOCUMENTS

| | | | | |
|---|---|---|---|---|
| 6,553,336 | B1 * | 4/2003 | Johnson et al. | 702/188 |
| 6,751,555 | B2 * | 6/2004 | Poedjono | 702/6 |
| 6,760,665 | B1 * | 7/2004 | Francis | 702/6 |
| 6,907,375 | B2 | 6/2005 | Guggari et al. | |
| 2008/0077479 | A1 * | 3/2008 | Carter et al. | 705/10 |

OTHER PUBLICATIONS

International Search Report and Written Opinion, International Application No. PCT/US2007/025807, dated Jun. 30, 2008.

* cited by examiner

*Primary Examiner* — Eliseo Ramos Feliciano
*Assistant Examiner* — Ricky Ngon
(74) *Attorney, Agent, or Firm* — Bracewell & Giuliani LLP

(57) ABSTRACT

A system to monitor drilling rig activity and to provide and manage drilling rig information, program product, and associated methods are provided. The system can include a communication network, a drilling rig information management server, a database accessible to the processor of the server, and drilling rig information management program product stored in the memory of the drilling rig information management server and including instructions that when executed by the processor of the drilling rig information management server cause the server to perform the operations of retrieving drilling rig location data from the database responsive to user selection of a geospatial location attribute, accessing digital mapping data to display a digital map associated with the user selected geospatial location attribute, and providing data to display indicia of a drilling rig location for at least one drilling rig overlaid upon and spatially oriented to at least portions of the digital map.

26 Claims, 24 Drawing Sheets

Rig Activity Accounts

Rigs Shown = 25
22-Dec-2006

| Contractor | Rig | Rig Type | Well Name | Well Number | Well Type | Spud Date | Drill For | Trajectory | Basin | State | County | MMS Area | MMS Block |
|---|---|---|---|---|---|---|---|---|---|---|---|---|---|
| ********** | 289 | Land | ********* | 5-2 | Development | 12/06/2006 | Gas | Vertical | ***** | Colorado | Archuleta | | |
| ********** | 753 | Land | ********* | 3 | Development | 11/13/2006 | Gas | Vertical | ***** | Colorado | La Plata | | |
| ********** | 56 | Land | ********* | 36-5 | Development | 12/05/2006 | Gas | Vertical | ***** | Colorado | La Plata | | |
| ********** | 545 | Land | ********* | 9F | Development | 12/07/2006 | Gas | Vertical | ***** | New Mexico | Rio Arriba | | |
| ********** | 507 | Land | ********* | 1 | Development | 09/28/2006 | Gas | Vertical | ***** | New Mexico | Rio Arriba | | |
| ********** | 222 | Land | ********* | 2 | Development | 10/03/2006 | Gas | Vertical | ***** | New Mexico | Rio Arriba | | |
| ********** | 1 | Land | ********* | 427A | Development | 10/03/2006 | Gas | Vertical | ***** | New Mexico | Rio Arriba | | |
| ********** | 283 | Land | ********* | 62C | Development | 10/03/2006 | Gas | Vertical | ***** | New Mexico | Rio Arriba | | |

Export To Excel

Fig. 8

Week of 29-Dec-2006

Selected Criteria

Country: United States States: All States County: All Counties Texas RR: All Districts Basin: All Basins Operator: All Operators

| Category | 29 Dec 2006 This Week | Wk-Wk Change | 22 Dec 2006 Last Week | Yr-Yr Change | 30 Dec 2005 Last Year | 2005 YTD | 2006 YTD | YTD Change | YTD % Change | Q3 2006 QTD | Q4 2006 QTD | QTD Change | QTD % Change |
|---|---|---|---|---|---|---|---|---|---|---|---|---|---|
| Total | 1710 | -13 | 1723 | 239 | 1471 | 1384 | 1649 | 265 | 16.1 | 1721 | 1719 | -2 | -0.1 |
| | | | | | | | | | | | | | |
| Land | 1604 | -13 | 1617 | 232 | 1372 | 1267 | 1537 | 270 | 17.6 | 1604 | 1609 | 5 | 0.3 |
| Inland Waters | 22 | 0 | 22 | 3 | 19 | 24 | 22 | -2 | -9.1 | 21 | 23 | 2 | 8.7 |
| Offshore | 84 | 0 | 84 | 4 | 80 | 93 | 90 | -3 | -3.3 | 95 | 87 | -8 | -9.2 |
| | | | | | | | | | | | | | |
| Gas | 278 | -1 | 279 | 43 | 235 | 195 | 274 | 79 | 28.8 | 306 | 285 | -21 | -7.4 |
| Oil | 1425 | -13 | 1435 | 191 | 1234 | 1186 | 1371 | 185 | 13.5 | 1410 | 1429 | 19 | 1.3 |
| Thermal | 7 | 1 | 6 | 5 | 2 | 3 | 4 | 1 | 25.0 | 4 | 5 | 1 | 20.0 |
| | | | | | | | | | | | | | |
| Vertical | 991 | -17 | 1008 | 98 | 893 | 862 | 980 | 118 | 12.0 | 1024 | 1015 | -9 | -0.9 |
| Directional | 382 | -3 | 385 | 29 | 353 | 341 | 384 | 43 | 11.2 | 397 | 385 | -12 | -3.2 |
| Horizontal | 337 | 7 | 330 | 112 | 225 | 181 | 285 | 104 | 36.5 | 300 | 319 | 19 | 6.0 |
| | | | | | | | | | | | | | |
| <5K | 83 | 1 | 82 | 20 | 63 | 59 | 75 | 16 | 21.3 | 78 | 81 | 3 | 3.7 |
| 5-10K | 662 | -6 | 668 | 154 | 508 | 469 | 608 | 139 | 22.9 | 646 | 654 | 8 | 1.2 |
| 10-15K | 684 | -7 | 691 | 23 | 661 | 613 | 699 | 86 | 12.3 | 733 | 710 | -23 | -3.2 |
| 15-20K | 240 | -3 | 243 | 21 | 219 | 224 | 238 | 14 | 5.9 | 233 | 241 | 8 | 3.3 |
| >20K | 41 | 2 | 39 | 21 | 20 | 19 | 29 | 10 | 34.5 | 29 | 33 | 4 | 12.1 |
| | | | | | | | | | | | | | |
| Exploration | 76 | 1 | 76 | 35 | 41 | 88 | 75 | -13 | -17.3 | 89 | 75 | -14 | -18.7 |
| Development | 1634 | -14 | 1648 | 204 | 1430 | 1296 | 1573 | 277 | 17.6 | 1632 | 1644 | 12 | 0.7 |

Fig. 9

RAIS

RAIS

RAIS

RAIS

RAIS

Fig. 25

| County/Parish/OffShore/State | Field/Area | Directions | Spud Date | To Date: | Status |
|---|---|---|---|---|---|
| ********* ***** | ******* ***** | ******* ***** | 04/22/2005 | 06/25/2005 | Complete |
| Well Name/Number | Operator | Operator Representative | | | |
| **** * ** ***** | ******** * ** ***** | ******** *** ***** | | | |
| Contractor | Rig | Contractor Representative | Drawworks | | |
| ******** ** ***** ** | 11 | / | | | |
| Salesman | Turnkey/Other | Pump 1/Liner / Pump 2/Liner | Mud System/Mud Co. | | |
| ***** ****** | / | PZ-10/6 / PZ-10/6 | Open / | | |
| Drilling Type/Directional Co. | Work Type | Survey | Abstract | Sect. / Coord. | S-T-R / Block |
| Horizontal/ ******* *** **** | Daywork | **** ****** | A-42 | D-3 | - - |

| No. | Size (in) | MFG | Bit Type | Nozzles (tfa) | Serial No. | Revenue Type | Measured Depth Out | Distance (ft) | HRS | ROP (ft/hr) | Accum DRLG HRS | WT (klbf) | Total (rpm) | Vert Dev Out | P.P. psi | Flow (spm) | Mud (ppg)/Dull Grading WT / 1 | FV / 0 | PV / DC | YP / L | FL / B/S | Type / G | SLDS / ODC | Date / RP |
|---|---|---|---|---|---|---|---|---|---|---|---|---|---|---|---|---|---|---|---|---|---|---|---|---|
| 1 | 8.75 | | XSC1S | 3x16 | 10692725 | Sale | 3012 | 159 | 3.5 | 45.4 | 3.5 | 48 | 30-35 | 0 | 2300 | 300 | 9.3 | 36 | 11 | 12 | 0 | W | 6 | 4/26/05 |
| BHA=1-8 3/4 Chr(34) SEC ROCK BIT, 1-6.75 Chr(34) LEAM MTR SET @ 1.75 DEG, 1-6.75 Chr(34) FLT SUB, 1-6.680Chr(34) NM X/O SUB, 1-6.875Chr(34) MWD TOOL, 1-6.810Chr(34) NMDC, 1-6.250 Chr(34), X/O SUB | | | | | | | | | | | | | | | | | 1 | 1 | WT | A | E | I | No | BHA |
| 2 | 8.75 | | FM3655 | 3x14,3x15 | 10568344 | Rental | 4375 | 1363 | 18.5 | 73.7 | 22 | 2-8 | 50-65 | 3.52 | 2950 | 455 | 9.5 | 41 | 11 | 14 | 0 | W | 7 | 4/27/05 |
| | | | | | | | 5846 | 2834 | 35.5 | 79.8 | 39 | 2-6 | 50-55 | 0.75 | 3400 | 455 | 9.5 | 37 | 11 | 13 | 0 | W | 5 | 4/28/05 |
| | | | | | | | 7362 | 4350 | 55 | 79.1 | 58.5 | 46 | 50-65 | 1.84 | 3500 | 428 | 9.6 | 36 | 5 | 10 | 0 | W | 5 | 4/29/05 |
| | | | | | | | 8343 | 5331 | 74.5 | 71.6 | 78 | 48 | 50-65 | 0.81 | 3600 | 409 | 9.6 | 36 | 5 | 13 | 0 | W | 5 | 4/30/05 |
| | | | | | | | 8914 | 5902 | 92 | 64.2 | 95.5 | 48 | 50-65 | 0.25 | 3600 | 398 | 9.6 | 35 | 9 | 16 | 0 | W | 6 | 5/01/05 |
| | | | | | | | 9184 | 6172 | 102.5 | 60.2 | 106 | 48 | 50-65 | 0.24 | 3600 | 398 | 9.9 | 35 | 9 | 18 | 0 | W | 8 | 5/02/05 |
| BHA=1-8 3/4 Chr(34) SEC 6 BLD PDC BIT, 1-6.75 Chr(34) LEAM MTR SET @ 1.83 DEG, 1-6.75 Chr(34) FLT SUB, 1-6.680Chr(34) NM X/O SUB, 1-6.875Chr(34) MWD TOOL, 106.810Chr(34) NMDC, 6.250Chr(34), X/O SUB | | | | | | | | | | | | | | | | | 1 | 2 | CT | S | X | I | WT | PR |
| | | | | | | | | | | | | | | | | | Bit was pretty balled up, change bit | | | | | | | |
| 3 | 8.75 | | FM3655 | 6x18 | 1059698 | Rental | 9720 | 536 | 17.5 | 30.6 | 123.5 | 4-12 | 60-70 | 1.18 | 3700 | 376 | 10 | 38 | 11 | 15 | 0 | W | 8 | 5/03/05 |
| | | | | | | | 10063 | 879 | 30.5 | 28.8 | 136.5 | 6-12 | 60-65 | 1.92 | 3700 | 375 | 9.9 | 38 | 10 | 16 | 0 | W | 8 | 5/04/05 |
| BHS SAME AS BIT #2, RAN 7 5/8Chr(34) CASING | | | | | | | | | | | | | | | | | 1 | 1 | WT | A | X | I | NO | TD |
| 4 | 6.125 | HCC | STX-1 | 3x20 | 5074155 | Sale | 10073 | 10 | 1 | 10 | 137.5 | 10-20 | 50-80 | 0 | 2200 | 295 | 8.3 | 28 | | | 0 | W | | 5/06/05 |
| | | | | | | | | | | | | | | | | | 1 | 1 | WT | A | E | I | NO | BHA |
| 5 | 6.125 | | FM2831 | 6x18 | 10648067 | Rental | 10341 | 268 | 15.5 | 17.3 | 153 | 5-10 | 0-0 | 0 | 3000 | 257 | 8.3 | 28 | | | 0 | W | | 5/10/05 |
| | | | | | | | | | | | | | | | | | 1 | 1 | WT | A | X | I | NO | BHA |

SYSTEM, PROGRAM PRODUCT, AND METHOD FOR DRILLING RIG ACTIVITY ACCOUNTING VISUALIZATION

RELATED APPLICATIONS

This application claims priority to and the benefit of PCT Patent Application No. PCT/US2007/025807, filed on Dec. 18, 2007, titled "System, Program Product, and Method for Drilling Rig Activity Accounting and Visualization," which claims priority to U.S. Provisional Patent Application No. 60/875,442, filed on Dec. 18, 2006 and is incorporated herein by reference in its entirety.

BACKGROUND

1. Field of the Invention

This invention relates in general to drilling rig data management and, in particular, to an activity accounting process and interactive data presentation system which utilizes Geospatial Information System Technology.

2. Description of the Prior Art

The assignee of the present invention, publishes extensive data on global rig activity known as "rig counts." Such data can be categorized in any variety of ways, such as by region (e.g., country, state, county, etc.), type of activity (e.g., drilling for oil or gas, geothermal, etc.), location (e.g., land or offshore), well type (e.g. development, exploration, or infill), or by well trajectory (e.g., directional, horizontal, or vertical). Information consumers use this data as a basis for forecasting business activities and investment decisions. Examples of information consumers include securities analysts, drilling company analysts, oilfield service company analysts, operator analysts, and government agencies. Recognized by Applicants is that such information consumers often view investments opportunities by basin and geological provinces, and thus, would find useful such data if compiled and reported by basin or geological province. Also recognized is the need for types of information beyond that provided by traditional "rig counts."

Rig counts have been historically published at fixed times. For example, international rig counts are published on a monthly basis, while publishing United States rig counts on a weekly basis. Recognized by Applicants is the need for such information supplied using different criteria such as, for example, historical (to provide trend information), at fixed calendar intervals, event driven (e.g., in response to a local or a global event or change in conditions), and on demand (e.g., just-in-time) such as at a critical stage in an investment decision-making process.

Also, historically, rig counts have been published ("pushed") in a "one-format fits all" presentation style. Recognized by the Applicants is the need for a new process which will allow individual users to tailor the type, amount, and format of the data that they want to "pull" when they wish to have an update and through which type of channel.

There are many disadvantages to traditional methods of rig counting. For example, historically, the rig counts have been "noisy" (or uncertain) due to a number of factors. First, for example, due to the remoteness of rigs and weather conditions, there are difficulties in validating actual rig activity in the field. Second, it is difficult to capture and transmit rig data from some locations. Also, continuous changes in the location of rigs, changes in the population of rigs due to newly constructed rigs, de-commissioning, and transfers between operators, etc. provide even more difficulties in this area. In addition, historically, rig counts have been a by-product of business activity service providers and not the result of a formal, dedicated business process. Recognized is the need for a new business process that eliminates or mitigates "noise" that allows a rig count information service provider to estimate the level of uncertainty or "noise" in the rig counts, and that provides quality assurance of the rig counts prior to provision to end-users (e.g., information consumers).

There are also other disadvantages in the traditional methods of presenting the rig counts. Historically, end-users of the rig counts access the information on-line as text reports or spreadsheets. This form of presentation has several drawbacks. For example, the end-users must re-enter the data into their proprietary analysis tools to derive useful interpretations, the data is presented statically, and, although the data has a critical geospatial dimension (e.g., location of oil and gas bearing formations, location of rigs, location of geopolitical boundaries, etc.), the data fails to reflect this information directly. Recognized by Applicants is the need to allow for layering and visualization of activity data over digital maps, and querying by means of interactions with graphical presentations of the data, which can enable new forms of interpretation by supporting the visualization of trends through, e.g., visual "playback" of trend data that will provide insights on individual rig behavior (e.g., rig movements over a period of time, depths drilled overtime) or rig herd behavior (e.g., movements of types over periods of time).

Recent advances in information technology enable a fundamentally new approach to the capture, management, and presentation of rig activity information. Such advances include interactive graphic interfaces, database systems, the Internet, portal technology, geospatial information system technology, and portable/wireless telecommunication devices. Accordingly, the applicants recognize the need to overcome these before mentioned disadvantages by integrating and extending these technological advances as addressed by embodiments of the present invention.

SUMMARY OF THE INVENTION

In view of the foregoing, embodiments of the present invention advantageously provide systems, program product, and methods which track, record, and manage drilling rig activity data to present the data in a high-quality graphical user interface using, e.g., geospatial models. Embodiments of the present invention also include dedicated systems to process rig data from various information providers and personnel, track and maintain rig activity information in a redundant system of record, and integrate this information and other types of information (e.g., economic, political, etc.) to present the information in an interactive geospatial model. Embodiments of the present invention also allows for a "push" and "pull" mode, as well as profile-based personalization of information, which dictates what information is presented, how that information is presented, and how often. Embodiments of the present invention advantageously provide a system, program product, and method which utilizes a combination of new processes to provide increased data quality in rig activity accounting and data verification, as well as increased user control and user-friendly interaction in rig activity data presentation, which allows users of such to access the rig activity information via a telecommunication device and query the system to receive the data based upon a variety of personalized attributes.

Specifically, embodiments of the present invention include a system to monitor drilling rig activity and to provide and manage drilling rig information. For example, a system according to an embodiment of the present invention can include a communication network, and at least one computer defining a drilling rig information management server positioned at a data center in communication with the communication network to provide user access to drilling rig information. The system can also include a rig information database accessible to the processor of the drilling rig information management server and including drilling rig activity data containing drilling rig location data for a plurality of drilling rigs. The system also includes drilling rig information management program product stored in the memory of the drilling rig information management server. The system can also include a plurality of user communication devices each positioned remote from the drilling rig information management server and having access to the communication network and having memory coupled to a processor to store operating instructions therein and to receive drilling rig activity data and digital mapping data, a user display in communication with the processor of the user communication device to display indicia of a drilling rig location overlaid upon and spatially oriented to at least portions of a displayed digital map, and a user interface in communication with the processor of the user communication device to provide each of a corresponding plurality of users with online access to the drilling rig activity data over the communication network to thereby view the drilling rig location for each of the plurality of drilling rigs.

The drilling rig information management program product can include instructions that when executed by the processor of the drilling rig information management server cause, for example, the drilling rig information management server, to perform the operations of retrieving drilling rig location data from the database responsive to user selection of a geospatial location attribute, accessing digital mapping data to display a digital map associated with the user selected geospatial location attribute, and providing data to display indicia of a drilling rig location for at least one drilling rig overlaid upon and spatially oriented to at least portions of the digital map. The program product can also include instructions that when executed by the processor of the drilling rig information management server, cause the server to further perform the operation of providing data to graphically display time-sequenced evolution of a drilling rig activity for a preselected region over a preselected period of time defining an extent of the time-sequenced evolution.

Embodiments of the present invention also include methods to monitor drilling rig activity and to provide and manage drilling rig information. For example, a method according to embodiment of the present invention can include the steps of accessing digital mapping data to display a digital map associated with the user selected geospatial location attribute, and providing data to display indicia of a drilling rig location for at least one drilling rig overlaid upon and spatially oriented to at least portions of the digital map. Advantageously, the geospatial location attribute can include at least one geological province or basin, and the indicia of a drilling rig location can be provided for each of a plurality of drilling rigs associated with a portion of the at least one geological province or basin displayed on the user display of a respective user communication device. The method can also include the step of graphically displaying a time-sequenced evolution of a drilling rig activity for a preselected period of time defining a time-sequenced evolution of transaction history. The time-sequenced drilling rig activity evolution data advantageously can include one or more of the following selected by a user: drilling rig location data describing drilling rig physical location movement within the preselected region, drilling rig monetary investment data describing investment progression within the preselected region, drilling rig asset data describing drilling rig asset movement into or out of the preselected region, personnel data describing movement in personnel into or out of the preselected region, or a combination thereof.

Embodiments of the present invention also include a computer readable medium including computer program instructions that when executed by a processor of a computer caused a computer to perform operations related to monitoring drilling rig activity and providing and managing drilling rig information. For example, a computer readable medium according to an embodiment of the present invention can include instructions that when executed cause a computer to perform the operations of accessing digital mapping data to display a digital map associated with the user selected geospatial location attribute, and providing data to display indicia of a drilling rig location for at least one drilling rig overlaid upon and spatially oriented to at least portions of the digital map. The operations can also include graphically displaying a time-sequenced evolution of a drilling rig activity for a preselected period of time defining a time-sequenced evolution of transaction history.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

FIG. 8 is a schematic diagram of a table providing rig details according to an embodiment of the present invention;

FIG. 9 is a schematic diagram of a table providing an activity report according to an embodiment of the present invention;

FIG. 25 is a schematic diagram of a webpage including a bit record produced through a bit management system according to an embodiment of the present invention;

DETAILED DESCRIPTION OF THE INVENTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

As shown in FIGS. 1-27, embodiments of the present invention relate generally to standards, models, systems, and methods for capturing, recording, transmitting, managing, providing quality assurance, analyzing, querying, reporting, and creative interactive visual presentations of data related to rig activity worldwide. More specifically, this rig activity data includes global records of oil and gas drilling along with certain characteristics of the rigs and the wells they drill. The embodiments of the present invention can also be varied to adapt to the local business environments of various countries.

Figure 1:
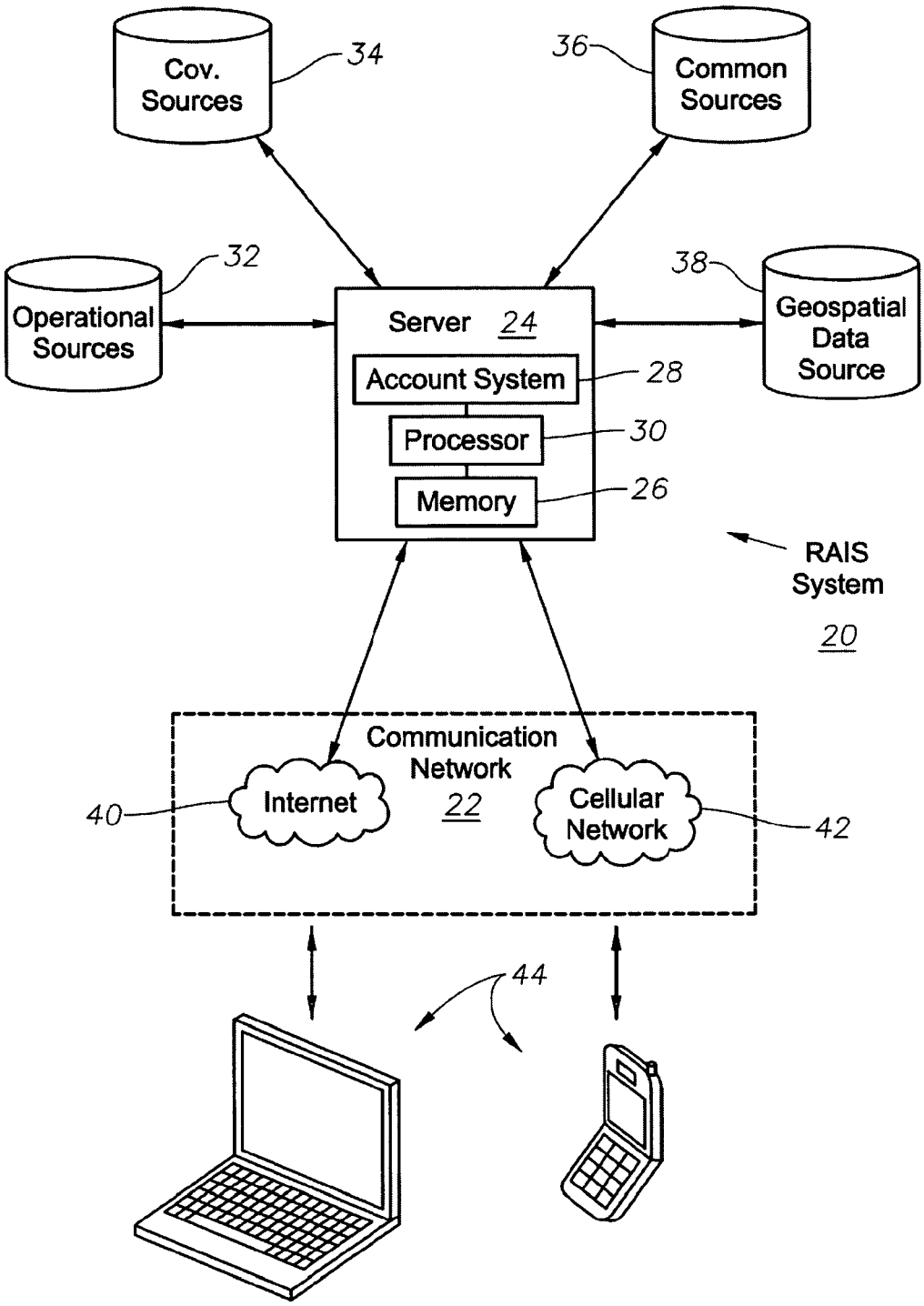
FIG. 1 is a schematic block diagram of a system according to an embodiment of the present invention.

FIG. 1 illustrates a Rig Activity Information Service ("RAIS") system 20 including a communications network 22 according to an embodiment of the present invention. The exemplary RAIS system tracks, records, and manages global drilling rig activity data to present the data in a high-quality graphical user interface using geospatial models. In this exemplary embodiment, the RAIS system 20 can include server 24 accessible via network 22 to host the interactive sessions of a plurality of users. Server 24 has memory 26, accounting system 28, and a processor 30 to store operating instructions therein, all of which being capable of bi-directional digital and/or analog communication with each other. Memory 26, however, could be a separate remote database, a cluster of databases, or some other form of memory device. Accounting system 28 could also be a separate remote database, system, or processor.

A variety of remote data sources feed or "push" rig data and related activity data (data can also be "pulled") into server 24 to be stored in memory 26 and used by processor 30 during user interactive sessions. These data sources can include, for example, operational sources 32, (which refers to data obtained from operations field personnel), governmental sources 34, and commercial sources 36, all of which are in bi-directional analog and digital communication with server 24. This data can be uploaded into remote data sources (32, 34, and 36) via any methods well-known in the art. Once uploaded, it is transmitted (or pushed) to server 24. In the alternative, the data can also be "pulled," or requested, by users during interactive sessions via communication devices 44. Note, communication devices 44 need not be in continuous communication with server 24. According to an embodiment of the system 20, applicable data for a predetermined area of operation can be "pulled" from the system 20, reviewed, displayed, and/or updated off-line, and later "pushed" back onto the system 20 using a synchronization process as known to those skilled in the art.

A geospatial database 38 is also in bi-directional communication with server 24 in order to provide geological, geographical, economic, cultural, or political data relevant to rig activity. Once the data has been received from remote data sources (32, 34, 36, and 38) it is processed and integrated together by processor 30 in order to form a geospatial model.

In an exemplary embodiment, communications network 22 can include cellular network 40 and the Internet 42, each being capable of bi-directional analog and digital communications between each other. Server 24 can be any well known shared computer located on RAIS system 20, which can function as the gatekeeper, controlling all functions of the present invention. Processor 30 performs the logic, computational, and decision-making functions of RAIS system 20 and can take any form as understood by those in the art. Memory 26 can include volatile and nonvolatile memory known to those skilled in the art including, for example, RAM, ROM, and magnetic or optical disks, just to name a few. It should also be understood that the preferred server configuration is given by way of example and that other types of servers or computers configured according to various other methodologies known to those skilled in the art, can be used.

Server 24, shown schematically in, for example, FIG. 1 can represent a server, server cluster, or server farm and is not limited to any individual physical server. The server sites may also be deployed as a server farm or server cluster managed by a server a telecommunications provider. The number of servers and their architecture and configuration may be increased based upon usage, demand and capacity requirements for RAIS system 20 or communications network 22.

In an exemplary embodiment, a cellular network 40 can also form part of communications network 22 and can take the form of any well known cellular mobile telephony system, thereby allowing users to access server 24 with a communications device 44, such as a cell phone. Any known telephony network can be integrated into communications network 22, such as those networks known in the art to support various communications devices such as smart phones, PDAs, Blackberries, or other handheld devices used to transmit both analog and digital voice, video, or data information between users. In addition to being a separate unit, server 24 can form part of communications network 22.

In another exemplary embodiment, server 24 can also be accessed through Internet network 42 via a plurality of communication devices 44, such as user personal computers. Each user communications device 44 can be positioned at one or more user sites remote from the server 24 and can take various forms such as, for example, a telephone, cell phone or personal computer that includes a display and input keyboard as is well known in the art. Although illustrated as a keyboard, a user's input can be entered by other forms of devices known to those skilled in the art such as, for example, a light pen, magnetic or optical card reader, trackball, touch screen, touchpad, or mouse. Further, user computers 44 can also take various forms known to those skilled in the art such as, for example, a desktop personal computer, a PDA, mobile telephone, and still other devices for accessing the Internet, that are adapted to interface with communications network 22 while positioned remote from the server 24.

Further, referring to FIG. 1, the data sources (32, 34, and 36) can include a variety of data related to, for example, attributes and activities of all drilling rigs located on RAIS system. This data, namely rig attributes and rig activities, can be located on the same or separate databases. In an exemplary embodiment, for each rig having attribute data corresponding thereto, RAIS system 20 also contains rig activity data for that particular rig (which is stored on a database, preferably one of data sources 32, 34, or 36).

In an exemplary embodiment, the rig attributes can include "rig counts" according to: (1) regions, such as, for example, the U.S., continents, countries, counties, states, or base geology (e.g., basins and geological provinces); (2) by locations, such as land or offshore; (3) by activity type, such as oil or gas drilling or geothermal; (4) well type, such as development, exploration, or infill; (5) well trajectory, such as directional, horizontal, or vertical; (6) physical attributes of rigs, such as equipment type and power; and (7) rig drilling and moving performance attributes. The rig activities can include, for example, rig counts according to time-indexed information on executed projects, such as time, location, objectives, KPIs, and outcomes.

Data source 38 (e.g., Geospatial data) can provide information related to various attributes spatially referenced on the earth using Geospatial Information System ("GIS") technology. GIS technology provides systems for storing, capturing, analyzing, and managing data and associated attributes, which are spatially referenced on the earth. More specifically, it is a computer system capable of integrating, storing, editing, analyzing, sharing, and displaying geographically-referenced information. GIS also allows users to create interactive queries or searches, analyze the spatial information, and edit the data. Any GIS technology well known in the art can be utilized with embodiments of the present invention. For example, GIS tools allow one to relate information about certain attributes of a state, such as drilling rig numbers and locations, to aerial photographs of the state. The primary requirement for the source data consists of knowing the location for the variables. The locations may be annotated by x, y, and z coordinates, longitude, latitude, and elevation, or by other geocode systems like ZIP codes or by highway mile markers. Any variable that can be located spatially can be fed into the GIS.

As shown in FIG. 1, the data received by server 24 from data sources 32, 34, 36, and 38 can be used by processor 30 to create a graphical user interface utilized during user sessions. Geospatial data source 38 can also be responsible for maintaining relationships between the location of projects executed by rigs identified by the other databases (data sources 32, 34, and 36) and geological, economic, political, and cultural records relevant to the decision process of information consumers. Processor 30 can utilize the data from data sources 32, 34, and 36 and can integrate it with data received from geospatial data source 38 (using GIS technology) to produce a graphical map illustrating the desired data. For example, GIS can utilize satellite images generated through remote sensing to produce a map-like layer of the number of rigs in a given area, historical rig attributes, time-based animations of rig behavior, or any other desired attribute.

The GIS technology used by processor 30 also can allow a user to personalize the interactive geographical visualization of the rig activity data received from data sources 32, 34, 36, and 38 and displayed on communication devices 44. A feature of an embodiment of the present invention allows individuals to tailor the type, amount, and format of the data they desire to pull, as well as when they wish to have an update and through which channel (e.g., website, RSS feed, etc.). Such personalized attributes can include: (1) information (both "pushed" and "pulled") based on user profiles registered with server 24; (2) user queries which present geospatial interfaces that visualize rig activity information based upon a combination of attributes such as, for example, (a) business attributes based upon specified operators or service companies; (b) rig attributes specified by rig equipment or performance; (c) activity attributes specified by oil or gas drilling or time of drilling; (d) location attributes specified by latitude/longitude, geographical or political jurisdictions, or onshore/offshore data; (e) geology attributes specified by geological provinces or basins; or (f) historical or time-dependent attributes, such as evolution of rig (or related) activity in a region over a period of time; (3) geospatial presentation of activity information layered on top of economic, geological or geographical, political, or cultural data; and/or (4) attributes which dictate how often the user desires to receive the rig data (e.g., fixed calendar intervals, in response to certain events, or on-demand).

Once the user has entered these personalized attributes, processor 30 integrates the data, using the GIS technology, for example, and transmits the data over communications network 22 to communication devices 44. Once received by communication devices 44, a map having the data layered on top (reflecting the personalized attributes entered by the user or retrieved from the stored user profile) is displayed on a display screen of communications device 44. In addition, the processor 30 can also transmit a time-based animation of rig behavior and related data for display on communications device 44.

RAIS system 20 can deliver the requested data to the user in any of the well-known presentation formats (e.g., HTML, XML, etc), which will allow users to programmatically transfer and integrate the data into their own analysis packages. In addition, graphical presentations of the rig data, using the GIS technology, enable RAIS system 20 to allow the visualization of trends through "playing" (as a motion picture) the rig data. This beneficially can provide users an insight on individual rig behavior (e.g., rig movements over a period of time, depths drilled over time, etc.), or rig herd behavior (e.g., movements of rig types, defining attributes, etc.) over periods of time.

Figure 2:
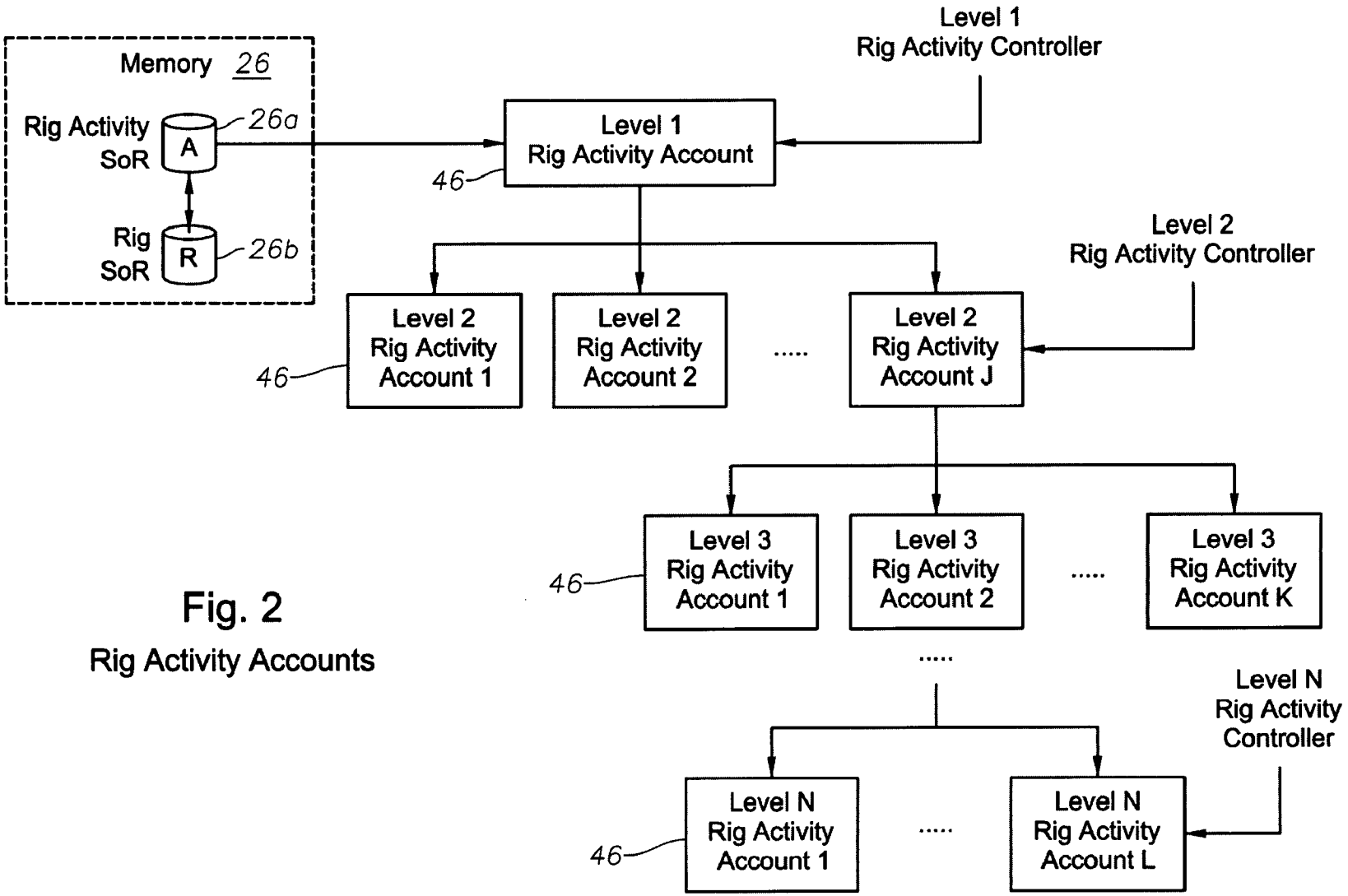
FIG. 2 is a schematic block diagram of a rig activity accounting process according to an embodiment of the present invention.

In another exemplary embodiment, processor 30 links rig activity records data received from remote data sources 32, 34, 36, with rig activity accounts data also received from the same. A double entry bookkeeping method and/or direct transfer-immediate update method, for example, can be used to manage rig transfers between accounts. Referring to FIG. 2, rig activity accounts 46 are bundles of data relating to specific rigs and their activity, which have been separated into discrete groups, called rig activity accounts. For example, such accounts can include all rigs in a specified region, state, country, etc. According to one configuration, a rig activity controller is assigned to each account. An organization of rig activity controllers is responsible for the operation and quality assurance of the rig activity accounts data.

Quality assurance of the rig counts is a critical component of the present invention. In order to ensure a high level of data reliability and to reduce, eliminate, or estimate uncertainty (noise) in the rig counts, the rig activity accounting process is organized hierarchically as illustrated in FIG. 2. In an exemplary embodiment, within sever 24, RAIS system 20 can maintain a master database of all available rigs worldwide at any given time. RAIS system personnel continuously update and verify the data related to their respective accounts (via remote data source 32) and transmit it to server 24. As illustrated in FIG. 2, for example, the rig accounting hierarchy in the U.S. may be structured geographically, such as, by state, stock point, county, etc.—while, a rig accounting hierarchy outside the U.S. may be structured by region, country, etc. In yet another example, the rig activity accounting hierarchies for rigs operating offshore may be structured based on the concept of blocks or leases.

Other criteria which may be used include hierarchies based on operators or contractors. As illustrated, Level 3 controllers report to Level 2 controllers, who then report to Level 1 controllers. There can be up to N number of reporting levels to accomplish the desired requirements of the system. Also, the hierarchy can be altered to meet system requirements. This process of accounting and redundancy allows RAIS system 20 to maintain the most accurate and reliable data regarding rigs and rig activity at any given time.

Once the data is reported and verified during the accounting process, it is uploaded and stored in memory 26. As reflected in FIG. 2, in an exemplary embodiment, memory 26 can contain separated linked databases for storing rig identification and attributes, called Rig System of Record (26*b*), and for storing transactional activity data, called Rig Activity System of Record (26*a*). In the alternative, however, these database can be combined into a single or multiple databases located remotely or within memory 26.

To further ensure quality and reliability, this data is constantly being updated and verified by RAIS system 20 and uploaded into memory 26. In one exemplary embodiment, however, such real-time data is only available internally to RAIS system personnel because it has not been verified. Once verified, the data is then made available to external users who can log on to server 24 via communication devices 44.

Figure 3:
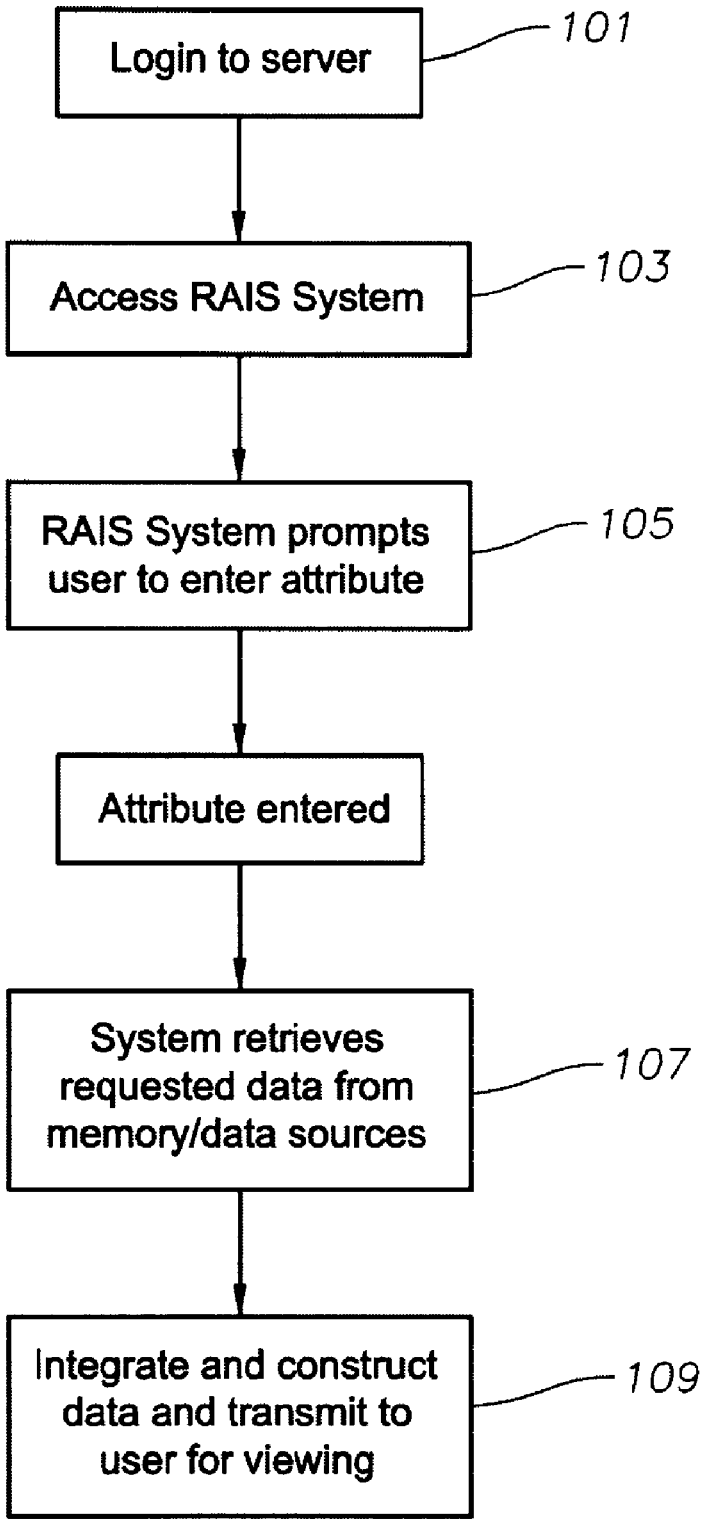
FIG. 3 is a high level flow chart according to an embodiment of the present invention.

Referring to FIG. 3, an exemplary embodiment according to a method of using the present invention will now be described. At step 101, a user logs into server 24 via communications device 44. The login process can be any method well known to those skilled in the art, such as those processors used in conjunction with a website or portal that requires a passcode to gain access. The website can also be subscription and fee based. The website can also or additionally be accessible to anyone in the general public or certain features of the website could be publicly accessible with other specific or proprietary data only available through a login.

In the restricted configuration or portion, once the user has been verified by processor 30, the user is allowed access to features of RAIS system 20 via a graphical user interface at step 103. Here, processor 30 prompts the user to enter any number of attributes the user desires to be visualized in the corresponding map display 105. Such attributes would be entered via an input device on communications device 44 (not shown). In the alternative, processor 30 could also retrieve (from memory 26) a previously stored profile of the user, which is then used by processor 30 to retrieve the desired data. Once entered, processor 30 processes the attribute data and retrieves the data from remote data sources 32, 34, 36, and 38 at step 107. In the alternative, some or all of the desired data may also be stored in memory 26 and can be accessed accordingly. At step 109, processor 30 then integrates the data into a visual map or other desired form (such as chart, graph, etc.) and transmits it to communication device 44 for display to the user.

Figure 4:
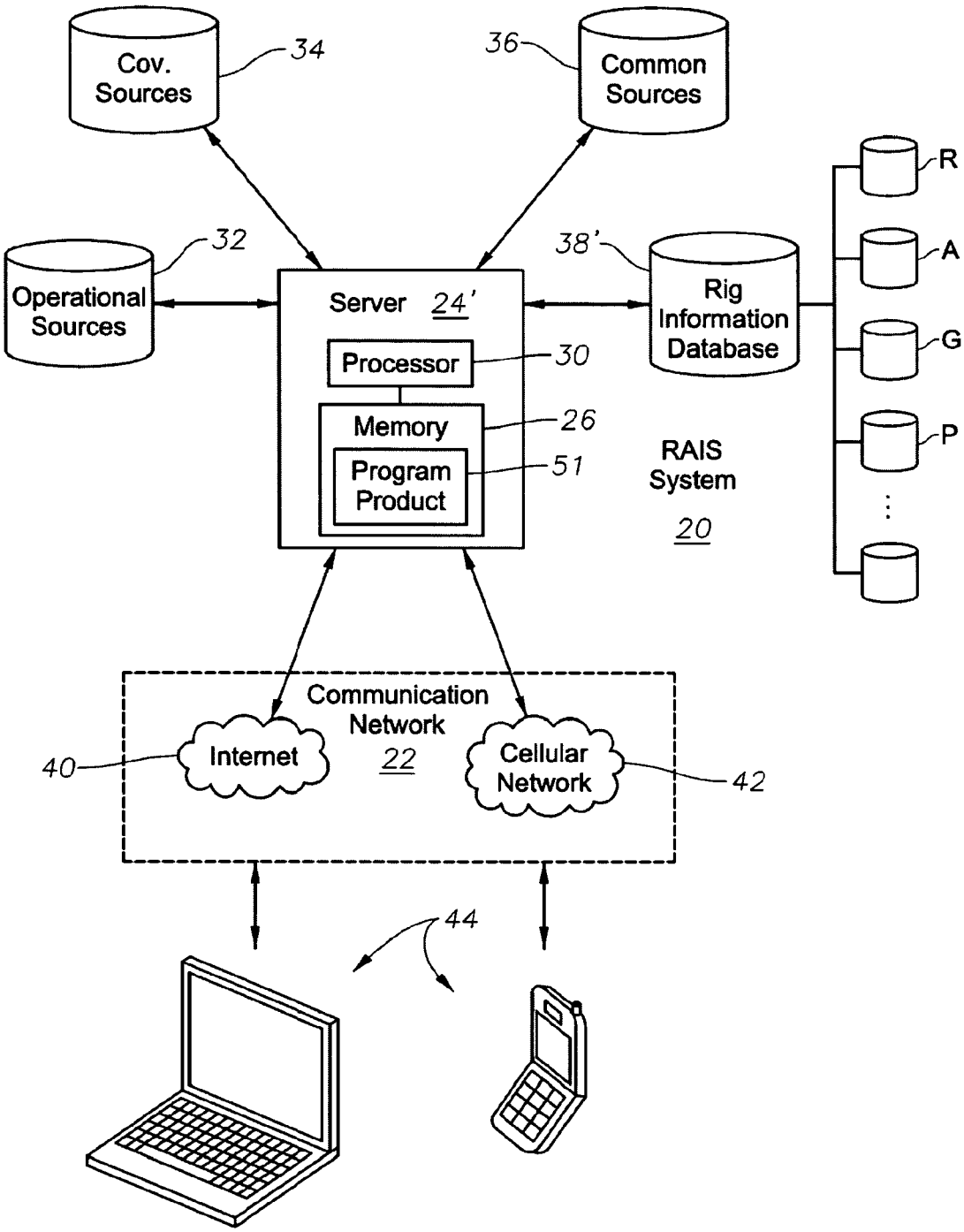
FIG. 4 is a schematic block diagram of a system according to an embodiment of the present invention.
Figure 5:
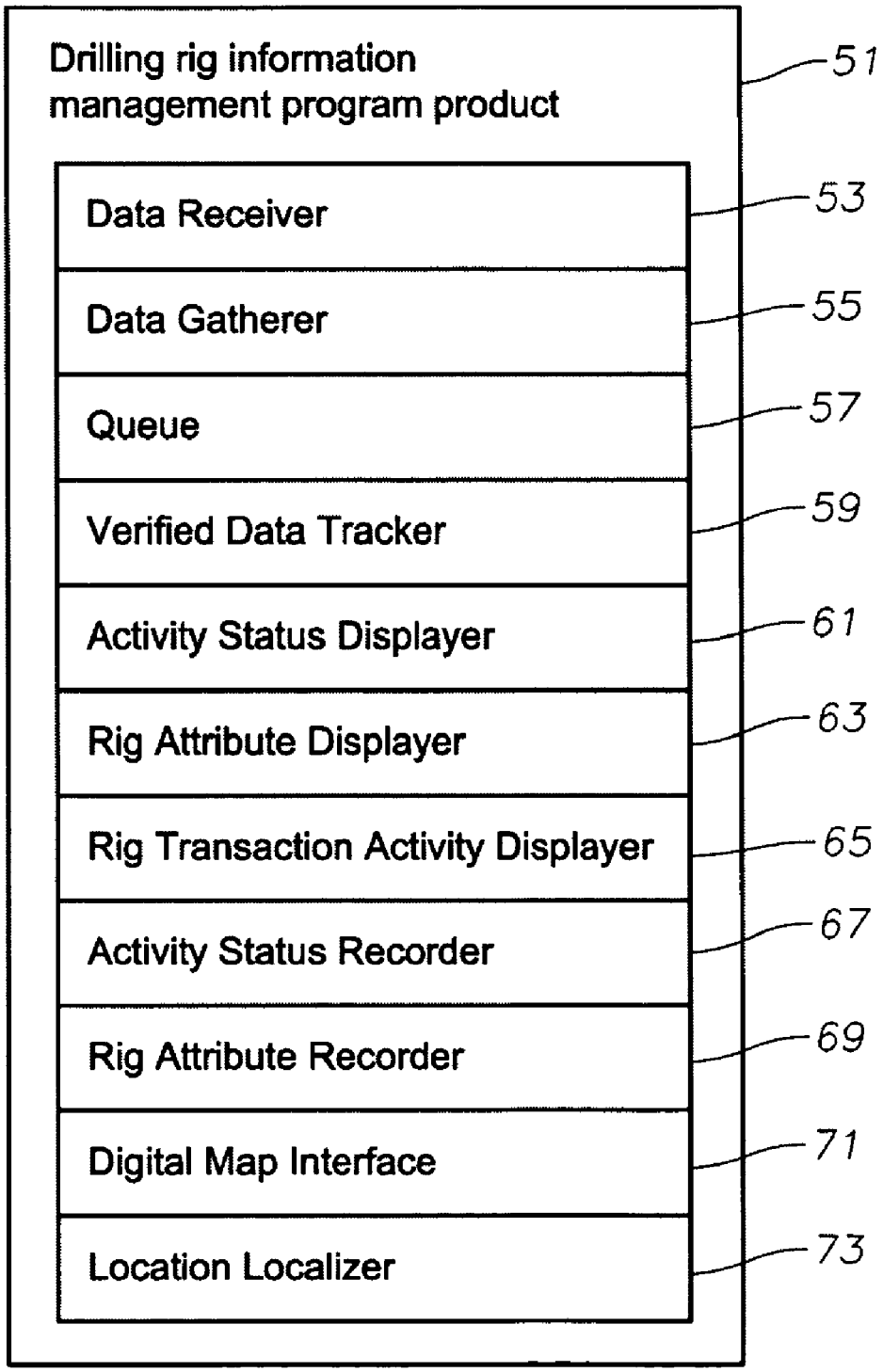
FIG. 5 is a schematic block diagram of a drilling rig information management program product according to an embodiment of the present invention.

FIG. 4 illustrates another exemplary embodiment of the system. System 20' can perform the above described functions of system 20 utilizing drilling rig information management program product 51 stored in memory 26 of server 24' and accessible by processor 30, along with one or more rig information databases 38' contained on a computer memory element (not shown) to relationally store drilling rig attribute data, drilling rig activity data, drilling rig assignment data, and drilling rig geospatial data, either or all of which can include, e.g., time-stamped historical data. For example, the drilling rig attribute data including, e.g., drilling rig business attributes (e.g., owner, operator, etc.), drilling rig physical attributes (equipment, power, trajectory, target hydrocarbon, depth, etc.), and drilling rig performance data (moving performance, drilling performance) can be stored in a first database R. The drilling rig activity data including, e.g., time-indexed data on projects executed, project description (includes time, physical location(s), objectives, KPIs, outcomes), can be stored in a second database A. Notably, the drilling rig location data can include data beyond that normally tracked such as, for example, basin and/or geological province data. A third database P or tables within one of the above databases R, A, can maintain attribute and/or activity data for rig information provider personnel. A fourth database G, if implemented, can maintain the relationships between the location of projects executed by drilling rigs (database A) and geological/geographical, economic, political, and cultural records relevant to the decision processes of information consumers, including, for example, location of major cities, basin boundaries, geology, County boundaries, highway locations, state boundaries, mineral management service (MMS) areas, and MMS blocks, defining geospatial information. Additional databases/records or tables within one or more of the above-described databases, can include, for example, information customers records, other assets, well attribute data including well type, well trajectory, etc.

As noted above, rig information databases 38' can also include mapping data to provide for the geospatial information. Alternatively, mapping data can be extracted through external database and combined with rig or well location data to instead provide the above described layering and visualization of activity data over digital maps. In either configuration, such visualizations can be provided through querying over the communication network 22 by means of interactions with graphical presentations of the data displayed on user communication devices 44, which can enable new forms of interpretation by supporting the visualization of trends through, e.g., visual "playback" of trend data that will provide insights on individual rig behavior (e.g., rig movements over a period of time, depths drilled overtime) or rig herd behavior (e.g., movements of types over periods of time), as will be described in more detail later.

User communication devices 44 can include various types of network and network capable devices including stationery and portable computers, PDAs, cellular phones, etc., which include a processor, memory coupled to the processor to store operating instructions therein (including, e.g., at least a rudimentary Web browser or other graphical application program) and to receive drilling rig activity data and digital mapping data. Each communication device can also include a user display in communication with the processor of the user communication device 44 to display indicia of a drilling rig location and/or other activity or trend information overlaid upon and spatially oriented to at least portions of a displayed digital map. Each communication device 44 can further include a user interface in communication with the processor of the user communication device to provide each of a corresponding plurality of users with online access to the drilling rig activity data over the communication network 22 to thereby view the drilling rig location for each of the plurality of drilling rigs. Such system configuration beneficially allows individual users to tailor the type, amount, and format of the data that they want to "pull" when they wish to have an update and through which type of channel, and allows the system 20' to provide such information using different or variable criteria, such as, for example, historical (to provide trend information), at fixed calendar intervals, event driven (e.g., in response to a local or a global event or change in conditions), and on demand (e.g., just-in-time) such as at a critical stage in an investment decision-making process.

The drilling rig information management program product 51 can be in the form of microcode, programs, routines, and symbolic languages that provide a specific set for sets of ordered operations that control the functioning of the hardware and direct its operation, as known and understood by those skilled in the art. As perhaps the shown in FIG. 5, the program product 51 can also include various functional modules containing instructions that when executed by a processor of a computer, cause the processor to perform various operations. For example, program product 51 can include a data receiver 53 adapted to pull or otherwise receive data from various internal and external sources using, for example, a data entry form (not shown), and/or a data gatherer 55, adapted to manage a WebCrawler to monitor select database sources to retrieve data updates. The program product 51 also includes a queue 57 adapted to receive third party drilling rig attribute and activity data for data validation review. The data receiver 53, data gatherer 55, queue 57, and/or a verified data tracker 59 are configured to notify a reviewer that data exists from a source other than an internal or external trusted source. The verified data tracker 59 manages sending an electronic message to a field representative either preselected, or selected, for example, by a data verification reviewer requesting visual verification of third party drilling rig activity data, and notifies the reviewer upon receipt of data verification to allow the reviewer to release the newly acquired data from the queue 57.

The drilling rig information management program product 51 can also include a rig activity status displayer 61 and a rig attribute displayer 63 to display rig activities and rig attributes, respectively, a rig transaction history displayer 65 display transaction history for a selected one or more drilling rigs or projects, and a rig activity status recorder 67 and rig attribute recorder 69 adapted to receive data for updating rig activity and rig attributes, respectively, for example, via a respective Web browser based database entry form.

Figure 6:
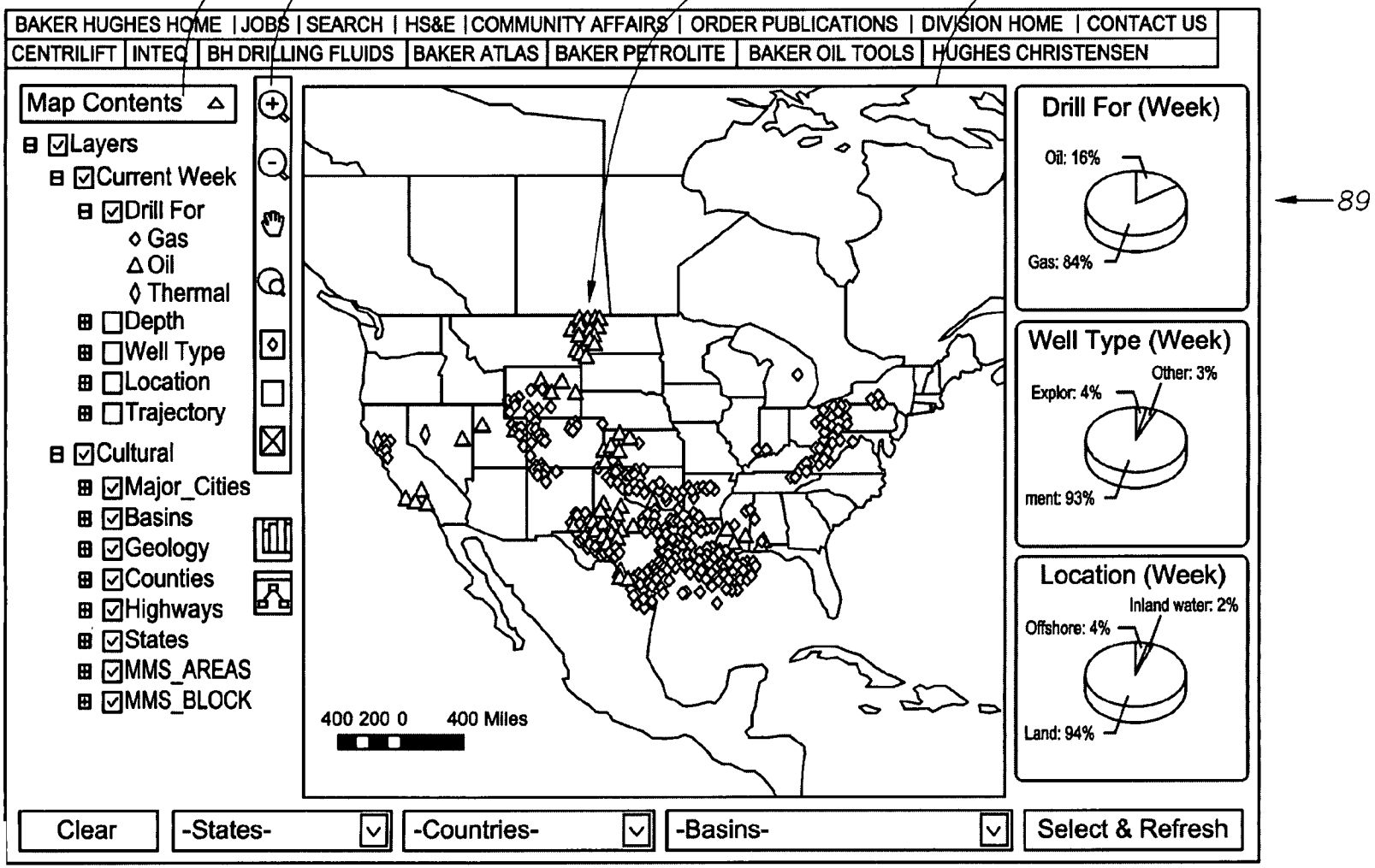
FIG. 6 is a schematic diagram of a geospatial webpage according to an embodiment of the present invention.
Figure 7:
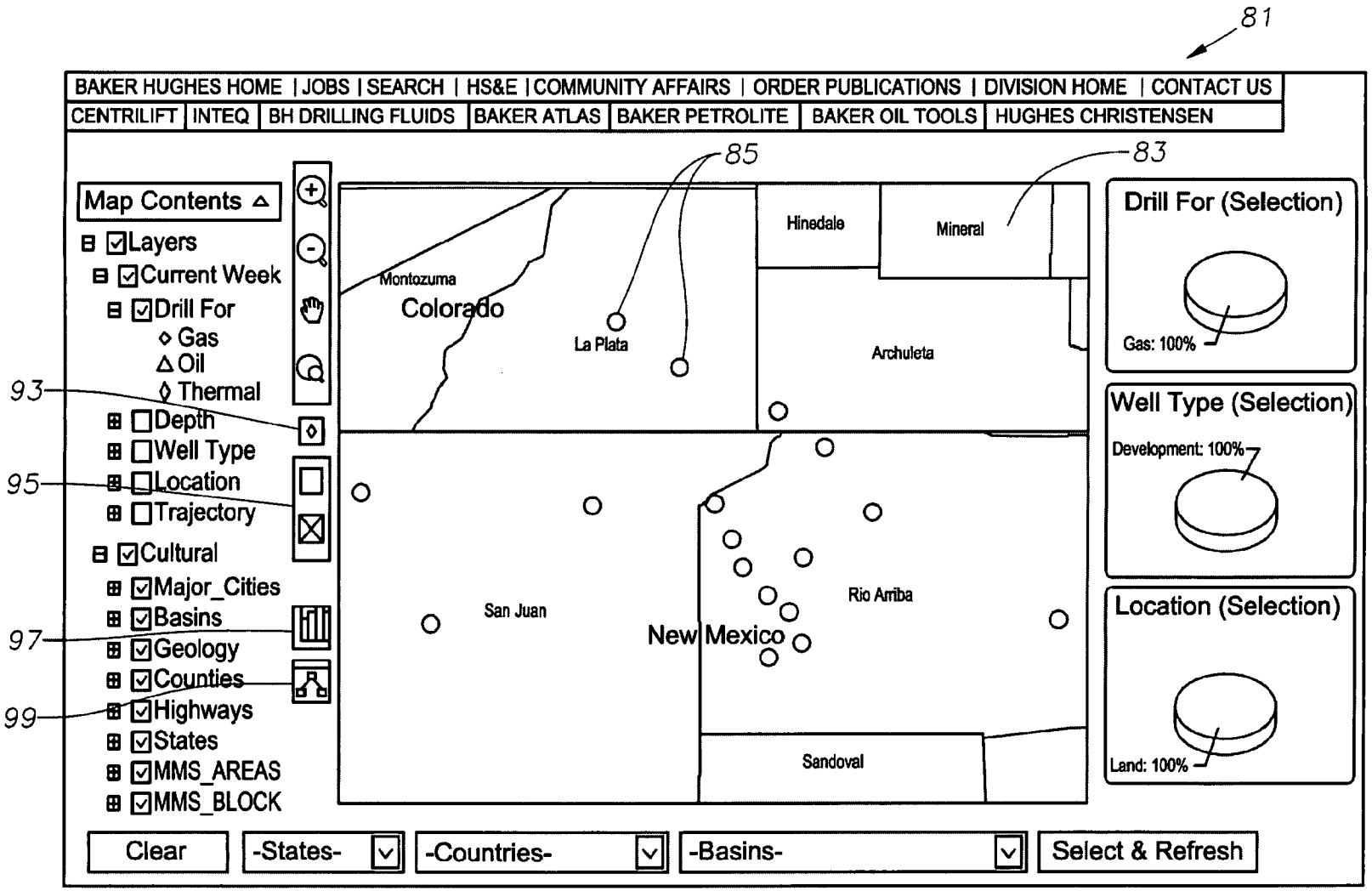
FIG. 7 is a schematic diagram of a geospatial webpage according to an embodiment of the present invention.
Figure 10:
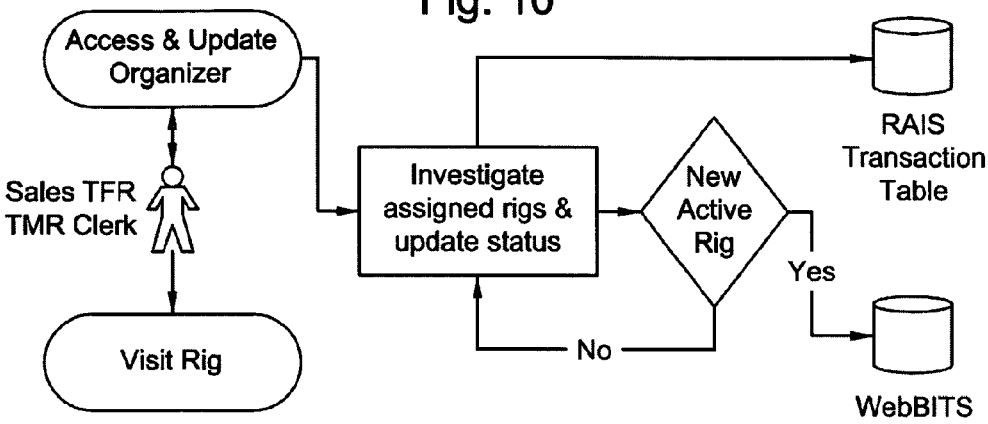
FIG. 10 is a schematic flow diagram of a process of updating multiple databases according to an embodiment of the present invention.
Figure 11:
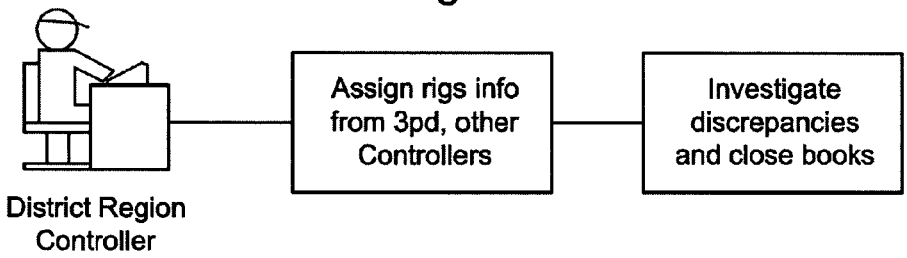
FIG. 11 is a schematic diagram illustrating assignment tasks of a District Regional Controller according to an embodiment of the present invention.
Figure 12:
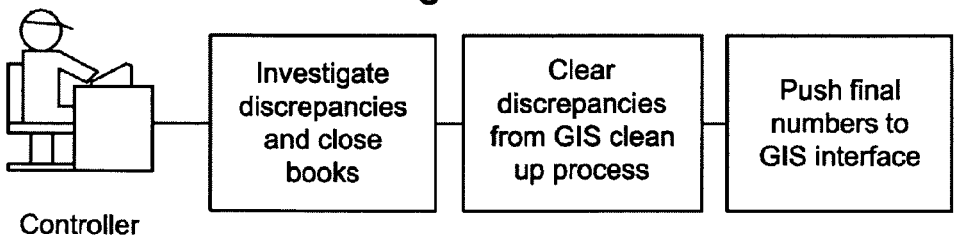
FIG. 12 is a schematic diagram illustrating assignment tasks of a Controller according to an embodiment of the present invention.
Figure 13:
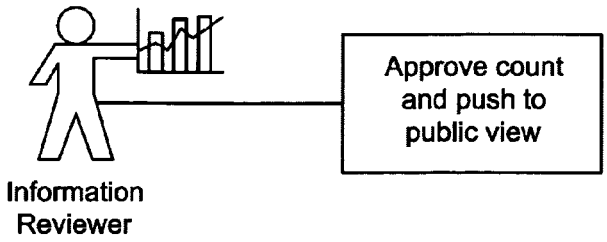
FIG. 13 is a schematic diagram illustrating assignment tasks of an Information Reviewer according to an embodiment of the present invention.

The drilling rig information management program product 51 can further include a digital map interface 71 adapted to retrieve digital mapping data (e.g., geological, economic, political, cultural) either directly from a and external digital map provider or via database 38, 38', and a location localizer 73 adapted to spatially orient a selected drilling rig or drilling rigs or projects with a selected portion of a digital mapping environment for display to a user, as shown for example in FIGS. 6 and 7.

As perhaps best shown in FIGS. 6-9, and as noted above, embodiments of the program product 51 provide geospatial visualizations and concise reporting data extending from the geospatial visualizations over the communication network 22 by means of interactions with graphical presentations of the data displayed on user communication devices 44. FIG. 6, for example, illustrates a geospatial webpage 81 containing a high-level view of any section of the world (here, the United States) positioned in a mapping field 83 overlaid with an illustration of various drilling rigs and operations (icons 85) at their respective locations. Webpage 81 includes a map content section 87 to allow user selection of the items to be layered over the digital map in the mapping field 83, along with statistics 89, and an activity interface 91. FIG. 7 illustrates a more detailed view of a selected portion of a map overlaid with the drilling rigs icons 85. The activity interface 91 includes several features including icons for performing the following functions of zoom in, zoom out, grab, zoom all the way out, select drilling rigs or projects for analysis, provide details for selected drilling rigs or projects, clear selections, provide reports, and provide time lapsed trend data. Specifically, icon 93 illustrates a box manipulated via a user input device over the communication network 22 to select one or more drilling rigs or projects. Having selected one or more drilling rigs or projects, icon 95 can be selected to provide rig details for the selected rigs or projects as shown, for example, in FIG. 8. Icon 97 can be selected to provide detailed reports including compiled and summarized information as shown, for example, in FIG. 9. Icon 99 can be selected to play back a visual display of the trend data such as, for example, movement of the drilling rig icons 85 in and out of the area of interest (i.e., existence or removal) and/or physical movement within the displayed area of interest, for example, in the form of streaming video. Beneficially, such imagery enhances visualization of a growth or decline in the area of interest. Note, the drilling rigs or projects were overlaid upon the map image in FIGS. 6 and 7. Alternatively, the image could have been a vertical planar or three-dimensional image illustrating depth into the earth. Accordingly, the trend information could show progression in an increase in a depth, changes in trajectory, or other data, for either an individual drilling rig or project, or a herd of drilling rigs or projects.

Additionally, other icons (not shown) can include those to provide either reports or trend information, visually illustrated as a function of time (i.e., progressive motion), or simple graphs or spreadsheets providing crew record data, power ratings of motors on the rig, reliability or maintenance records. Such other icons can also include those to provide real-time video at the site, or portions thereof, or a picture of the rig, etc.

Embodiments of the present invention address the root cause of drilling rig accounting problems, "noise" due to inaccurate observations and implementation of unverified drilling rig attribute and activity data. As perhaps best shown in FIGS. 10-19, embodiments of the present invention include procedures defined for, e.g., field operators, rig controllers, etc., that eliminate or mitigate "noise" that allows a rig count information service provider to estimate the level of uncertainty or "noise" in the rig counts, and that provides quality assurance of the rig counts prior to provision to end-users (e.g., information consumers).

For example, as shown in FIGS. 10-14, data verification is provided, for example, through direct visiting of the drilling rigs by field representatives, and the investigation of assigned rigs to allow verified updates to transaction tables and drilling rig databases. As perhaps best shown in FIG. 10, rig accounting has been beneficially made separate, but complementary, to drilling bit record management, to provide a single entry point for updating and managing both drilling bit record and drilling rig activity and information records. Such rig accounting can include defined accounting periods with reconciliation procedures including move-ins and move-outs, implementation of a rig accounting standard handbook to provide standard accounting procedures to field representatives, and transparency, particularly with respect to on demand auditable "books" and reporting to management. As perhaps best shown in FIG. 11, according to a preferred configuration, District Regional Controllers assign rig information received from third parties or other controllers for investigation of discrepancies and to "close the books." As perhaps best shown in FIG. 12, specific Controllers investigate discrepancies; clear the discrepancies from the Geospatial Information System, e.g., data source 38, or from database 38'; and update the final "corrected" numbers. As perhaps best shown in FIG. 13, an Information Reviewer approves the rig count data for release to external customers.

Beneficially, application of such dedicated roles responsible for rig activity accounting, e.g., region or district-level rig activity controller and rig master coordinator, approval for public release of data further enhances not only third party trust in the accuracy of the databases, but enhanced prevention of corruption of the database with faulty data. Note, FIG. 14 illustrates a sample high-level flow diagram of steps involved in validating newly acquired drilling rig activity or attribute data, and FIGS. 15-19 further illustrate specific process flow diagrams to further enhance data verification.

Figure 14:
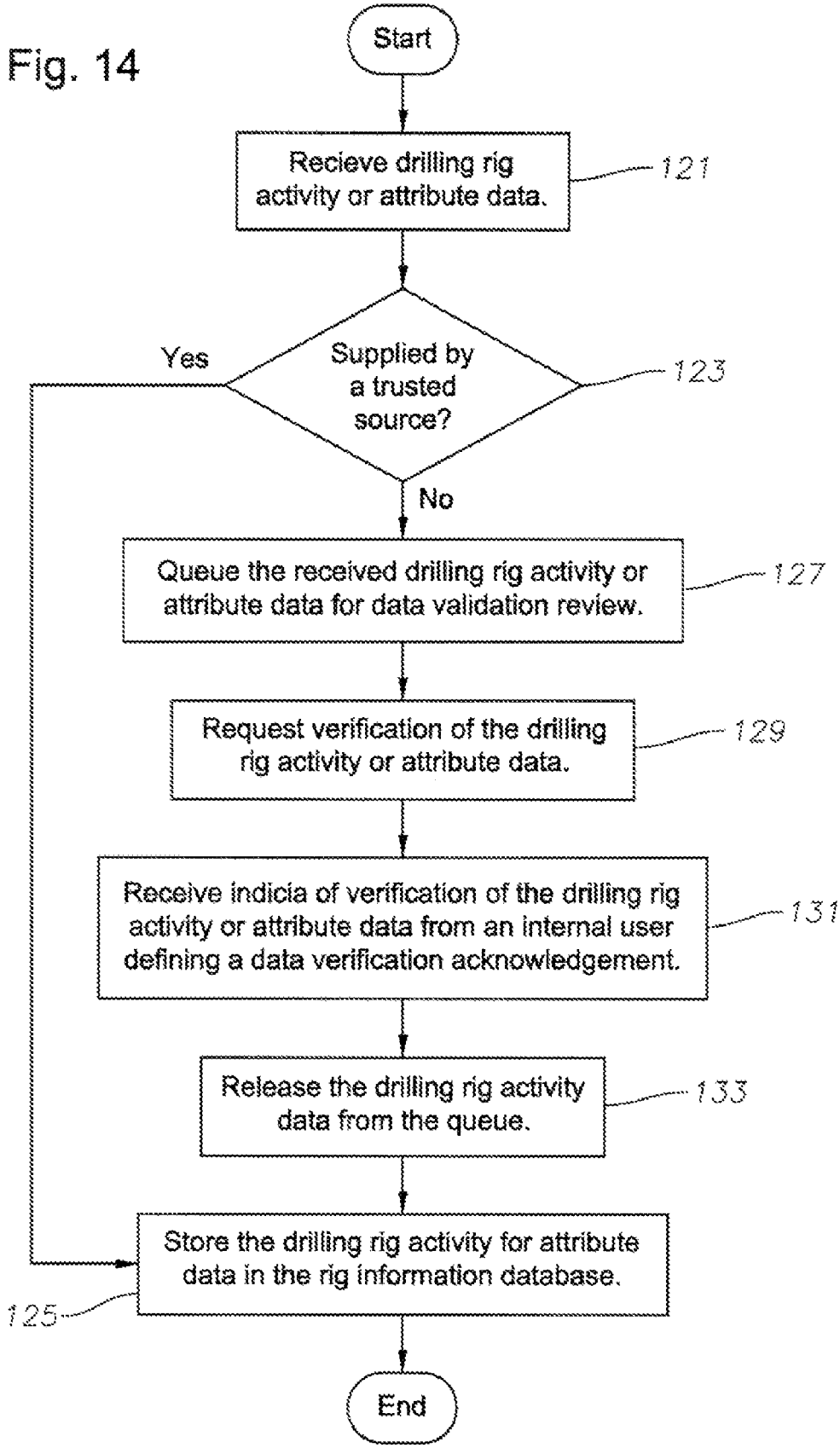
FIG. 14 is a schematic flow diagram illustrating a process for validating newly acquired drilling rig activity or attribute data according to an embodiment of the present invention.
Figure 15:
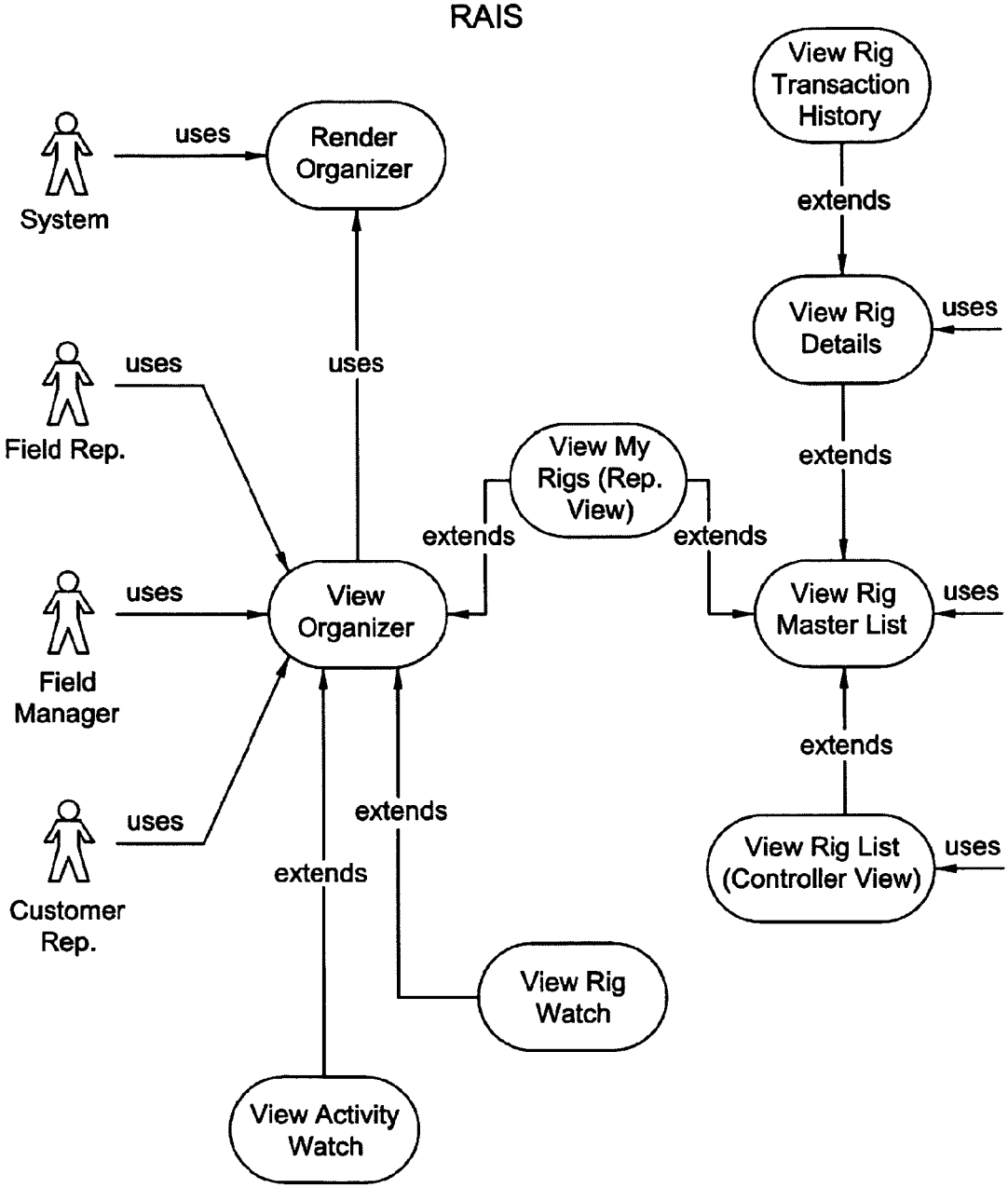
FIGS. 15-19 are schematic diagrams illustrating an interrelationship process flows used to enhance acquisition, validation, and presentation of drilling rig activity or attribute data according to an embodiment of the present invention.
Figure 16:
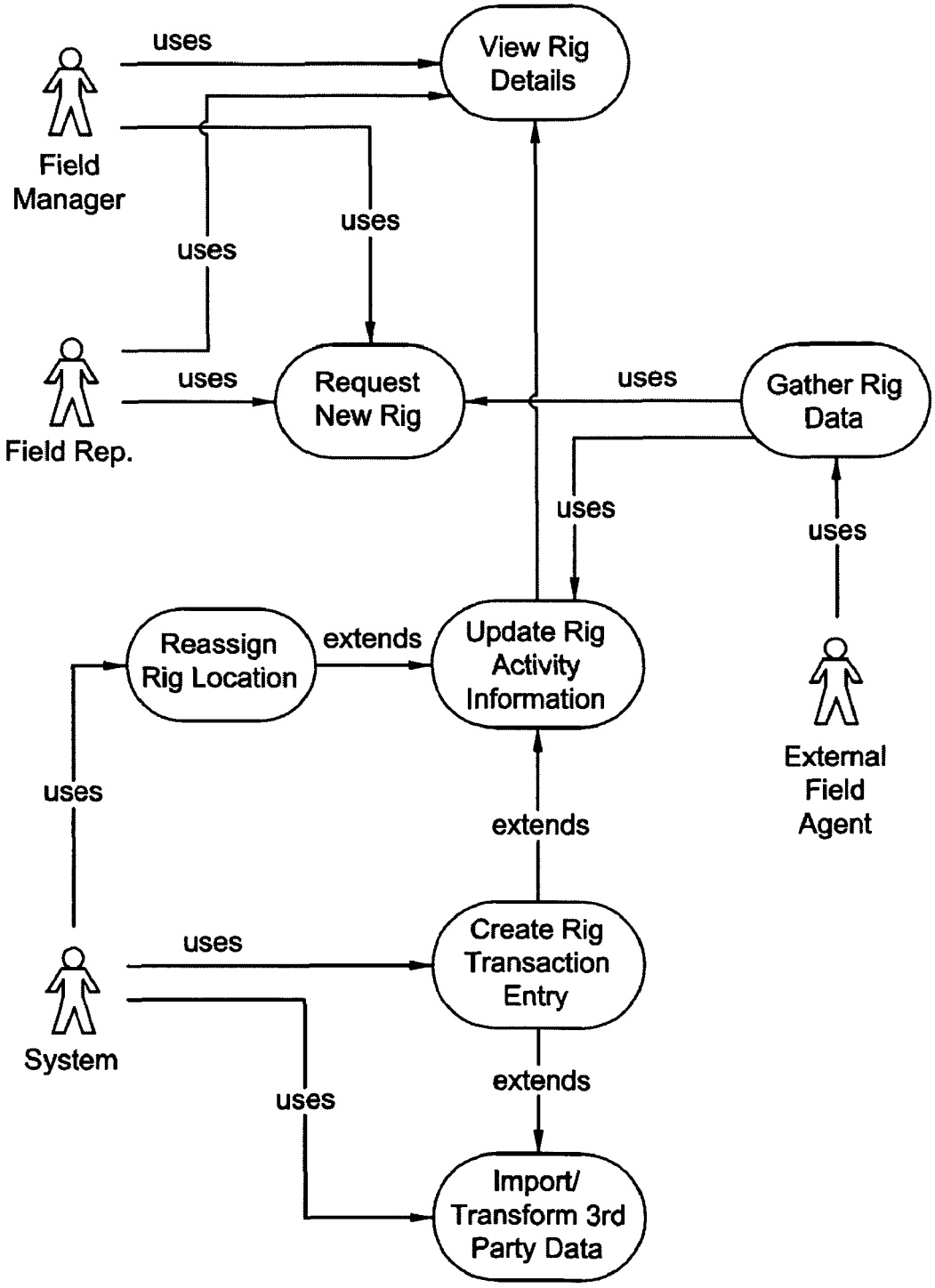
Figure 17:
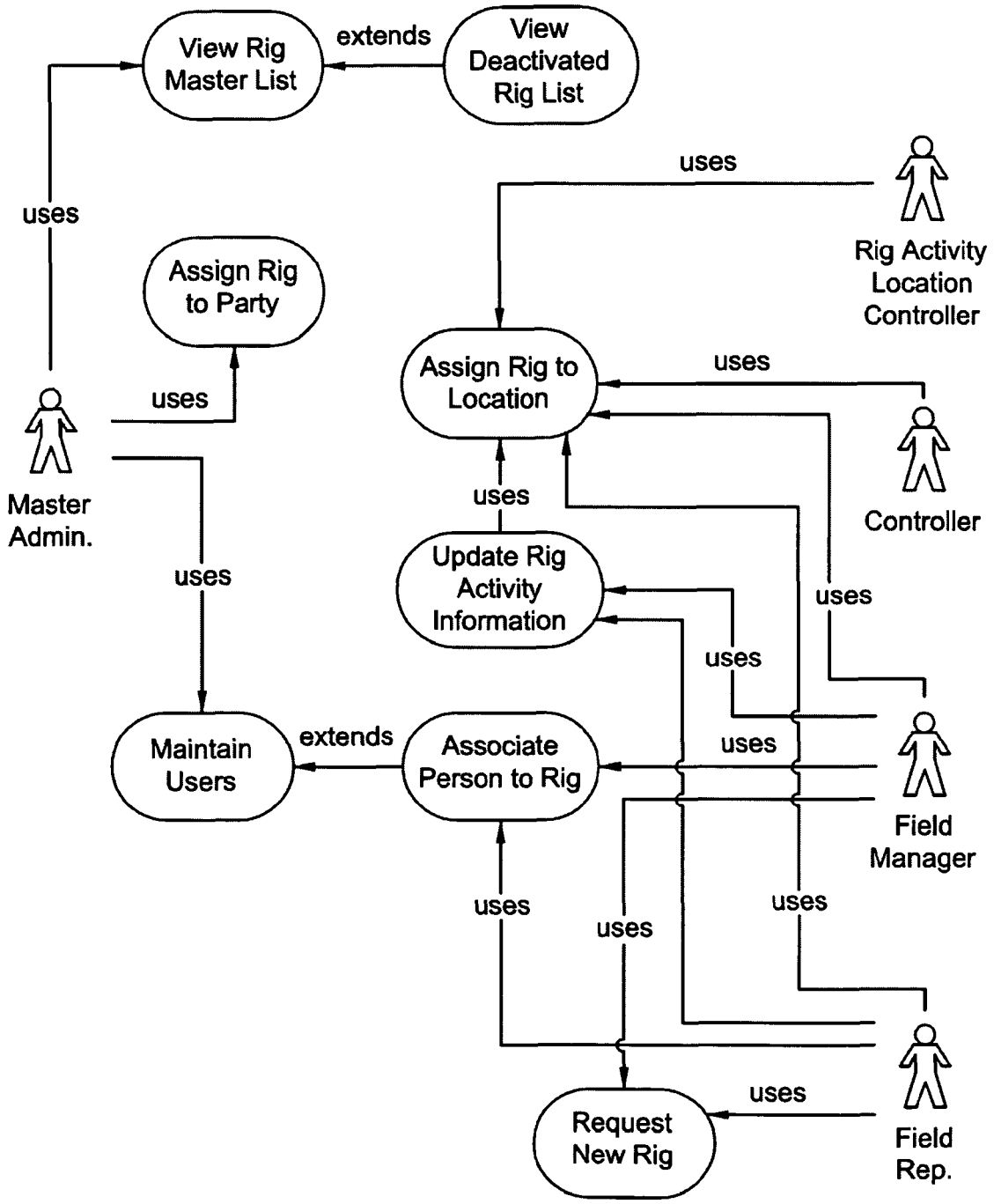
Figure 18:
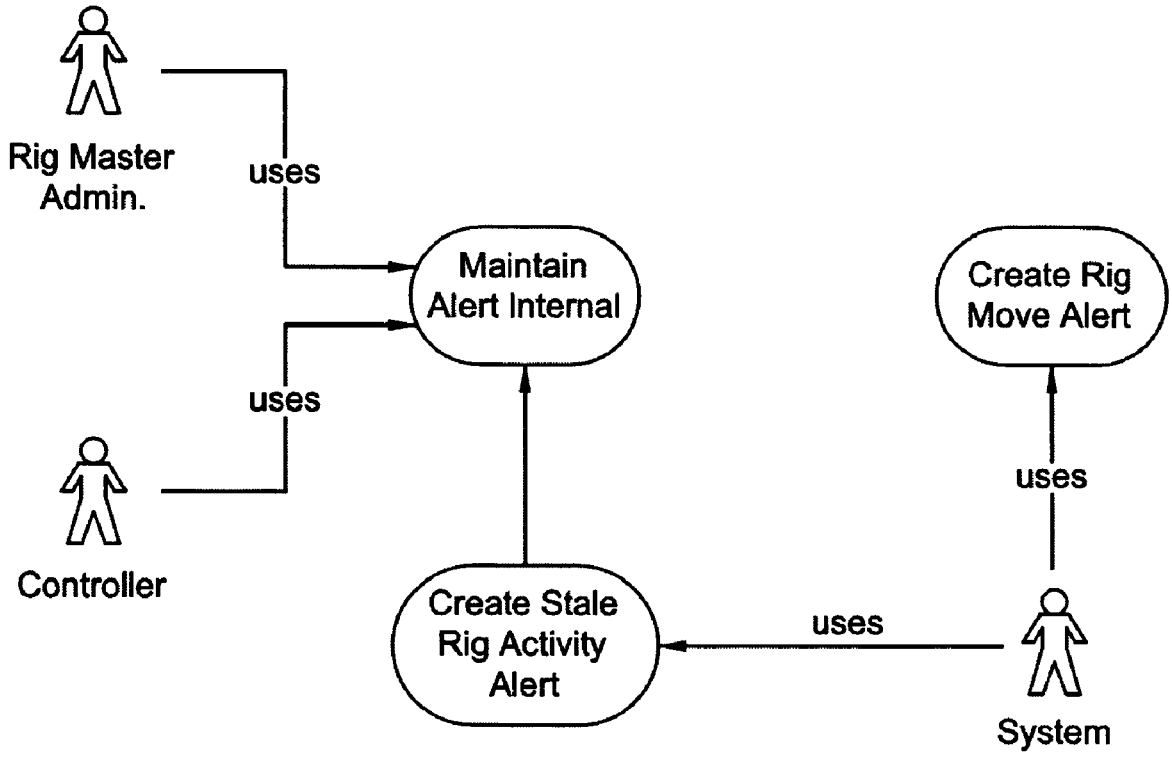
Figure 19:
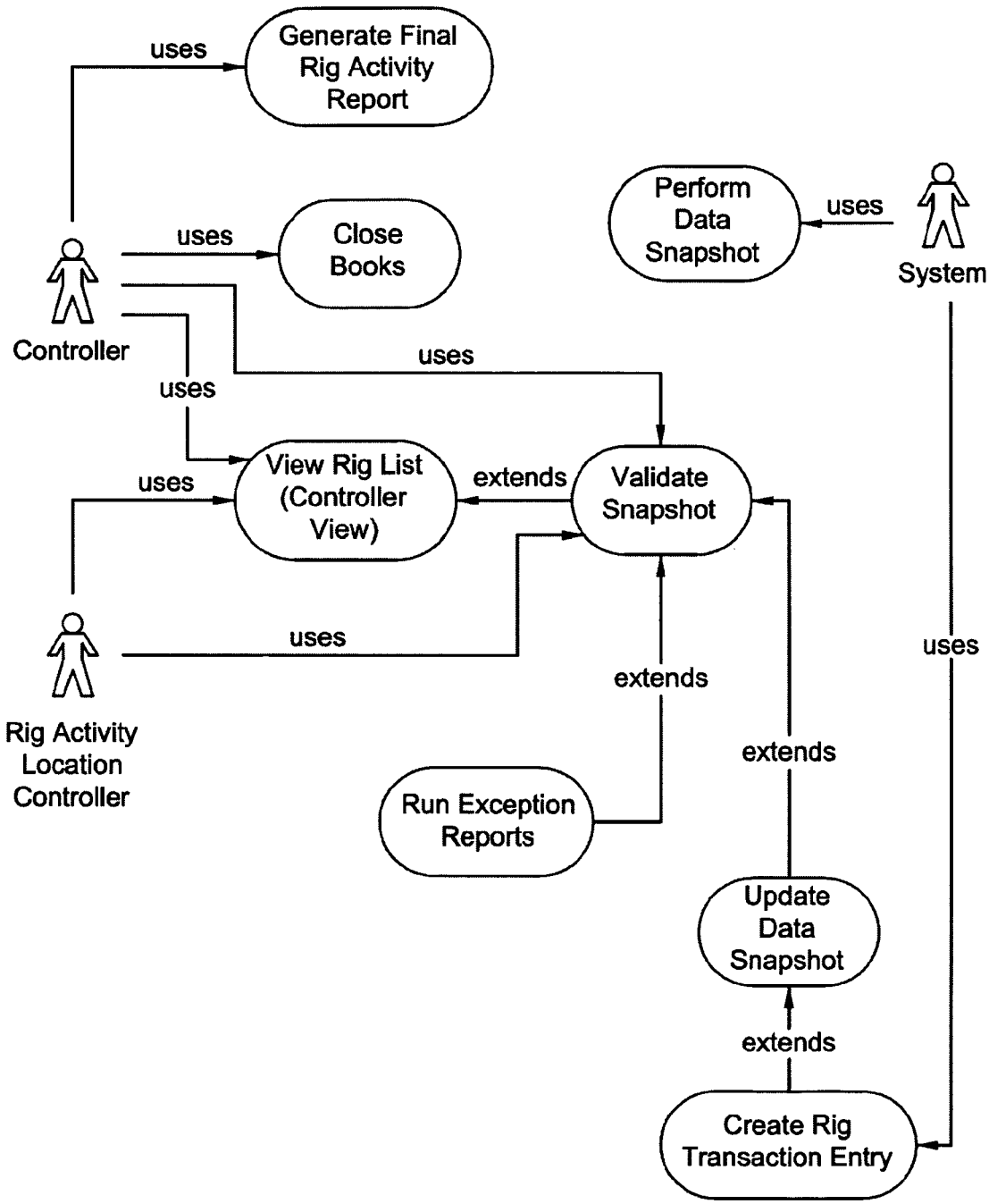

As illustrated in FIG. 14, a method to monitor drilling rig activity and to provide drilling rig information can include the steps or operations of receiving drilling rig activity or attribute data from a plurality of users entered into a standardized Web based database entry form (step 121), and if the users are internal users or otherwise trusted data sources (step 123), storing the internally supplied drilling rig activity or attribute data in a rig information database responsive to receipt of the drilling rig activity or attribute data (step 125). If the data sources are not trusted data sources as identified in step 123 (i.e., if the level of uncertainty of the data is unacceptable), the method further includes queuing the received third party drilling rig activity or attribute data for data validation review (step 127); requesting, e.g., visual, verification of third party drilling rig activity or attribute data (step 129), receiving indicia of physical verification of the received third party drilling rig activity or attribute data from an internal user (e.g., field representative) defining a data verification acknowledgment (step 131); releasing the third party drilling rig activity or attribute data from the queue responsive to receipt of the data verification acknowledgment (step 133), and storing the third party drilling rig activity or attribute data in the rig information database 38' (step 125).

As noted above, embodiments of the present invention move the "counting" paradigm to that of "accounting." FIGS. 15-19 illustrate various process flow diagrams that provide an enhanced methodology for storing, updating, and displaying such improved data. Additionally, FIGS. 6-9 and 20-27 provide examples of an enhanced graphical user interface for storing, updating, and displaying such improved data. Note, only select Web-type page screenshots are shown to enhance clarity.

Figure 20:
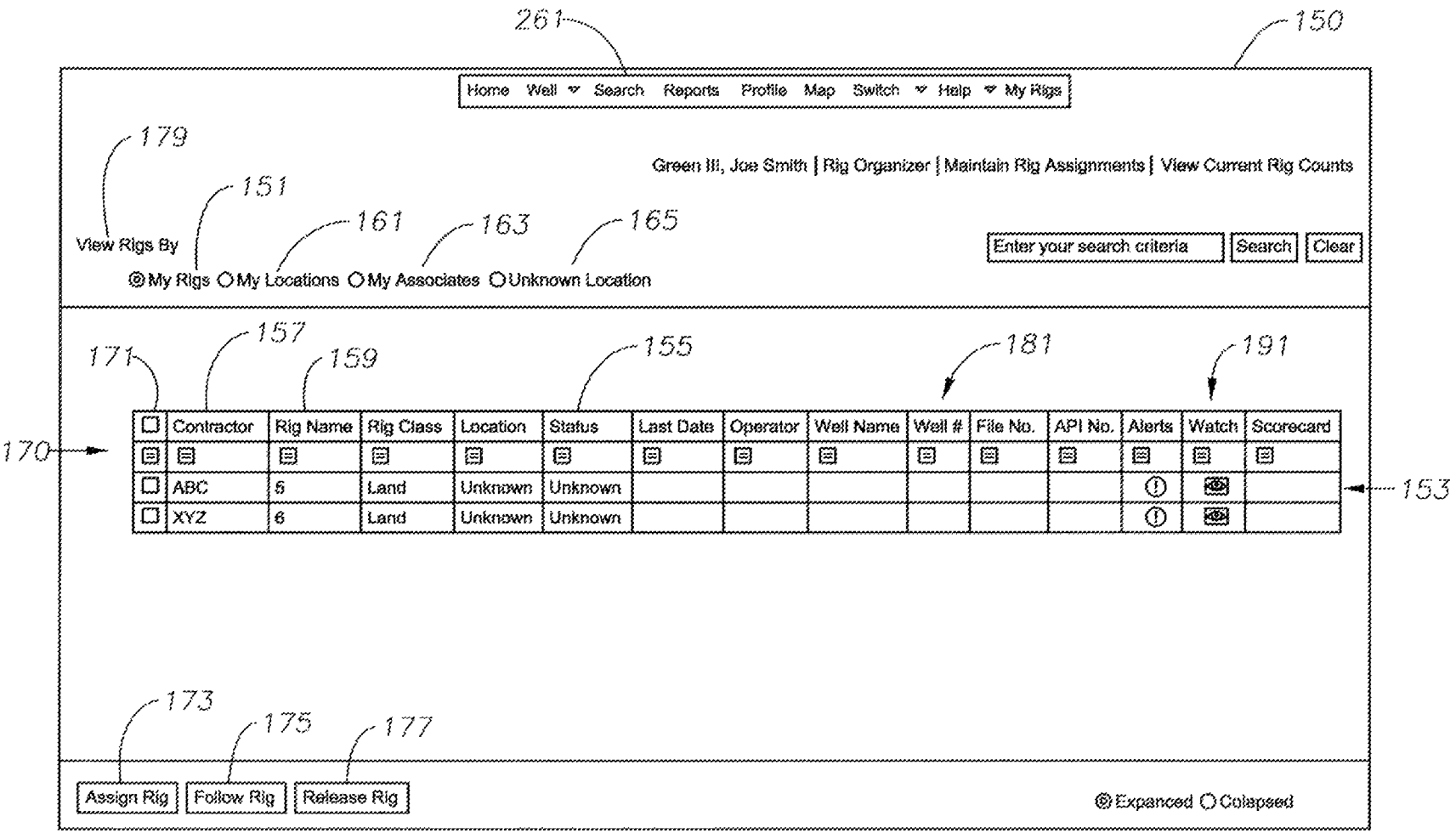
FIG. 20 is a schematic diagram of a rig organizer webpage according to an embodiment of the present invention.

For example, as shown in FIG. 20, through selection of "my rigs" field 151 on the rig organizer page 150, embodiments of the present invention allow users, such as, for example, field representatives, to view a list 153 of rigs that are directly assigned to them. The provided list 153 of drilling rigs, is, by default, sorted first by status 155 (with "Active Drilling" first), then by Contractor 157, and then by RigName 159. Users, e.g., field operation managers, through selection of the "my locations" field 161, for example, can view the list of rigs that are located in any of the business units in which the manager is a member based on the most recent rig transaction. Similarly, through selection of the "my associates" field 163, the user can view the unique list of rigs that are associated to any of the persons assigned to any of the locations in which the user is a member. This list (not shown) is, by default, grouped, e.g., by Contractor, then sorted first by status (with "Active Drilling" first), then by Contractor, and then by RigName. Through selection of the "unknown location" field 165, users can view the list of rigs that have no location value assigned based on the most recent rig transaction. This list (not shown) is, by default, sorted first by status (with "Active Drilling" first) and then by updated date.

According to a preferred configuration, each of the above scenarios can produce a rig list data set which contains the following fields:

Rigs Organizer Field List

| Field | Description |
|---|---|
| Contractor | The name of the Contractor. |
| Rig Name | Name of the rig. |
| Rig Class | Rig classification (barge, ship, jack up, etc). |
| Location | Shows geographical location of the rig, if available. For offshore this will be the offshore "county" concatenated with offshore block. For onshore, it will be the state concatenated with county. If the location is Unknown, third party data is used if available. |
| Status | Displays the Current Rig (transaction) Status. If the location is Unknown and status is Unassigned, third party data is used if available. |
| Last Date | Displays the date (only) of the last transaction status. |
| Operator | The name of the Operator. If the rig is not in Active Drilling status, then this column is empty |
| File No. | Displays the well's file No. (if the status is active drilling). The file number is hyperlinked and when selected, will direct the user to the bid management page ("Webbits") displaying the well header screen corresponding to this File No. |
| API No. | Displays the well's API No., if it exists. |
| Alert Status | Displays an icon if one or more of the following alerts have been triggered for this rig: Third Party Data is Newer: Either "3rd Party Data indicates this rig reached total depth well XYZ on <DATE>" or "3rd Party Data indicates this rig Spud'ed well XYZ on <DATE>"; these alerts compare the total depth date and Spud date from third party data to the RAIS transaction data and raise an alert if this date is different so long as the third-party data date is newer than the transaction date. Rig is Stale; the rig has not been updated since the allowable threshold; this is controlled by the rig class with the units being in days. Rig has Unknown Location. Rig has Unknown Status. Active Rig is Active without well header. When the user puts the mouse over the icon, the specific alerts are displayed in a tool tip. |
| Watch Status | The watch status displays one of four icons indicating who is watching the rig. No one in the location is watching I'm watching Someone (anywhere) is watching Both are watching When the user puts the mouse over the icon, the specific list of users watching the rig is displayed. |

According to this configuration, the user can manipulate the rig list in the following manner: Sorting: The user will be able to sort on any single column in the list by clicking on the column name cell. When the same column name is clicked repeatedly, the sort order is reversed from the previous order. The initial or "default" sort is first by "Activity Status" showing active, active not drilling, moving, stacked, and unknown in this order and then by updated date. Grouping: The rig list can be grouped by one or more columns, for example, when the user drags the column above the grid header. Paging: The rig list will be paged to limit the number of records displayed at one time. Column Order: The user may manipulate the column order in the rig list by dragging the columns in front or behind of each other. According to a preferred configuration, none of the custom settings are persisted or saved with the user profile, meaning that any custom view can't be stored and retrieved later. The records can also be sorted by each column (single column sort), for example, when the column header is selected.

In the exemplary illustration, each item 170 in the rig list (e.g., list 153) contains a checkbox 171 that allows the user to toggle the rig items and the ability to toggle all items (to check or clear all). The buttons 173, 175, 177, below the list enable the user to "Assign Rig" "Follow Rig" or to "Release Rig." The "Follow Rig" button 175 is disabled if the "View By Assignment" dropdown has been selected to display "My Rigs." In addition, the "Follow Rig" and "Release Rig" buttons 175, 177, should be disabled when no items are checked in the rig list and enabled only when one or more items in the list have been checked. Further, each item or record (row) 170 in the rig list 153 can be double clicked which loads the "rig details" page 200 (FIG. 21) displaying the rig details of the double clicked rig. That is, the user can click an individual rig item or record 170, which then starts, for example, a rig details module to allow the user to drill into the details of the rig. Each checkbox for each rig record also enables the user to "Unassign this rig" which removes the association between that user and the rig, i.e., through selection of the "release rig" button 177. A notation of this operation is placed in the rig's audit (transaction) history to track such details. The organizer page 150 also contains a "View By" filter graphically illustrated at 179 that, as shown in the figure, is, by default, set to "rigs assigned to me" (or "My Rigs"), but can also be changed to "rigs by territory" (or "My Locations") which presents a list of territories assigned to the user (such as stock points). By default all rigs associated with all territories assigned to the user are displayed. When the user selects a specific territory, the rig list is filtered by rigs in that territory (not by person assignment). A third filter can include "rigs not assigned to a territory" (or "Unknown Location") that displays all of the rigs that do not have any territory which could occur for various reasons but mostly when a rep creates a "move" transaction without specifying the new location. This feature is provided so that if a field representative is "driving around" and discovers a rig that is not in his area in the system, the rig can be entered into the system.

According to an embodiment of the present invention, when a request to view the organizer page 150 is received by the user interface of the system, the system will first determine the identity of the person making the request. Then, for each item in the composite, the system calls a series of operations to retrieve the data for that component and for that person. The object retrieved is a representation of the data to be presented/rendered. Then the system updates each of the corresponding user interface components with the data retrieved for that specific component. According to this exemplary embodiment of the system, the rules/criteria for the datasets are as follows:

| | |
|---|---|
| MyRigs | Returns all rigs associated to that identity making the request. |
| Rig Watch | Returns the list of all rigs in his rig watch. The rig watch is a list of rig "alerts" that was added in the database for the specific user and rig and that is only removed from this list once the user either associates the rig to himself or explicitly says "remove from this list." |
| Alerts | Returns all alerts assigned to that user that are still have an opened state. |
| Activity Watch | Returns the list of all rigs assigned to that person that also have the last activity date value less then the configurable stale activity threshold time span. This value is configurable by rig type and so first the type of rig must be checked and then the appropriate configurable time-span value is used to get the list of rigs. |
| Score Card | Returns scores for that user. |

As noted above, embodiments of the system 20, 20', allow the user to view the list of rigs assigned to him/or (default view) on the organizer page 150. The "My Rigs" is an area or region (like a web part) within the organizer page 150 that lists each rig assigned to the user in a grid or tabular format. According to alternative configuration (not shown), the grid contains the rig identification, contractor, telephone, rig watch status, activity watch status, and current activity status columns and latest update date. The rig and activity watch status columns list contain an indicator such as, an icon, which indicates that this type of item is present (rig watch, activity watch is set on this rig) while the activity status column contains the actual status of the activity itself. The following five characters provide a standard status: AD for "Active Drilling"; AND for "Active Not Drilling"; SSO for "Stacked or Suspended Operation"; UO for "Unassigned/Opportunity"; and M for "Moving." Note, for rigs associated with a well, the system can display the well record in an additional "well information" field or screen, which is part of the rig record. This well information field will be empty if there is no well associated with a particular rig record.

The embodiments of the system 20, 20', allow the user to display a list of new rigs arriving into the area set, for example, by the "District Champion," for which field users can assign to themselves. To perform such display, the user first views the "rig watch" section 191 of the organizer page 150 (FIG. 20). The rig watch section 191 is a portion of the organizer page 150 that can list rigs, including those that are moving to the user's specified area. According to one configuration, the criteria for displaying the rig to the current user listed in his/her rig list 153 is defined as follows: When a rig is moved (geographical location change) a record is created in the rig watch for each person that is assigned to a stockpoint associated with that "new" geographical location which the rig has been "moved" to (or assigned to). Even if the user is already assigned explicitly to that rig the user will receive a notification which could happen if the rig was moved out and back in for some reason (maybe data error) and that person hadn't "unassigned" it from him/herself directly. Rigs are removed from this list if and only if the user assigns one or more of them to him/herself, for example, using the "assign rig" button 173, or has explicitly clicked "take off my list" ("release rig" button 177) which removes it from the list. As noted above, this particular section includes table or list 153 which can show the "my rigs" by rig identification and contractor, which, upon selection, provides the user the ability to view its details and/or also assign it to himself, or if logged in with, e.g. a Field Manager role, allows the rig to be assigned to him/herself and/or to any other person associated to that same stockpoint.

The embodiments of the system 20, 20', also allow the user to display a list of rigs that have not been updated/validated/confirmed within the allowable time span. To perforin such display, the user first views the activity watch section 193 of the rig details page 200 (FIG. 21) selected, for example, through the organizer page 150. The activity watch section 193 provides various alerts including identification rigs that are assigned to the user which have not been updated within a period of time defined in the system. The system should determine both the type of rig and the check the time span that is associated for that particular rig type. The user can click an individual rig identification or contractor, which then causes display of rig details to allow the user to drill into the details of the rig.

Figure 22:
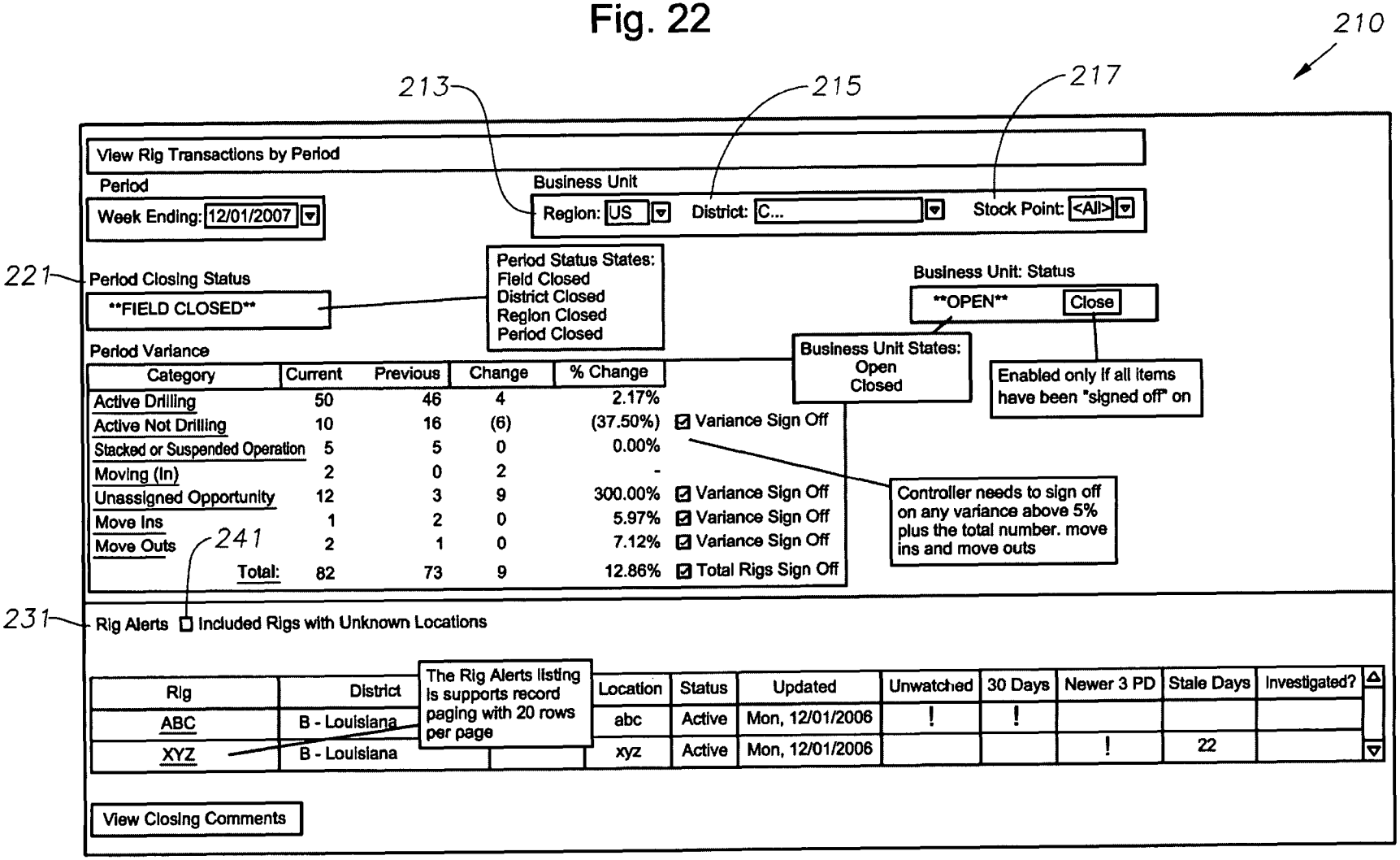
FIG. 22 is a schematic diagram of a rig transactions webpage according to an embodiment of the present invention.

As perhaps best shown in FIG. 22, Rig Activity Location Controllers and other Rig Controllers are provided additional data in the form of transactions related to all of the rigs in all of the territories assigned to user from the latest snapshot data source, while the live grid contains all of the rigs assigned to all territories associated with the user using the "latest" entry from the live transactions for that rig, with a default showing all rigs grouped by location and categorization. Specifically, the user can be presented with a grid containing the rig transaction data displaying various combinations of the following fields: rig identification; type; contractor; current accounting status; date of last accounting update; district; stockpoint; if the rig is assigned and/or who it is assigned to; and contains exceptions (snapshot view only). The "contains exceptions" field (not shown) can be a button that is only present if there is one or more exceptions. When clicked, it presents the user with a grid of all the exceptions that apply to this rig. Beneficially, the user can filter the rigs by a number of criteria. Each criterion is displayed with a dropdown box that includes an implicit "all" and is presented just above the grid itself.

The various filters used to display the data can include, for example: "By Contractor"; "By Accounting Status"; "Rigs without geographical location set"; "By Any Territory (region, district, stockpoint, etc.)"; if it contains zero or more "exceptions"; if there is at least one person assigned to it or not; if there is at least one person assigned to it in the same geographic location; last transaction date is greater than one week (configurable); pervious transaction was greater then 4 weeks (configurable) than the last transaction; "View Rigs Not Serviced"—e.g., all rigs that a certain proprietor does not do business with; "View Previous Rig Categorization"—e.g., how rigs were categorized historically for a previous count; "View Changed Rig Categorization"—rigs that have been updated to a new categorization in the current time period; and "View Rig Movement by Location"—a list of rigs that have moved into or out of a user's assigned territory. Note, the illustrated embodiment in FIG. 22 is "by Period." According to a preferred configuration, the filter criteria are already "pre-filtered" based on that person's access. For example, if a Controller is only granted access to a limited number of regions or districts, that Controller can only "see" these in the controller's dropdown list.

The user can sort the data by any single column, for example, by clicking on the column header. "Clicking" the same column again sorts the data in reverse order on that same column. The grid is paginated to limit the amount of data displayed. The number of records per page is configurable by the user with a default setting of "twenty." The user may view the next or previous page (if applicable) and also "jump" to a specific page by selecting the indicator for that page. The user may also click on one of the rig records, which will cause to display of the "Rig Details" page 200 (FIG. 21).

Figure 21:
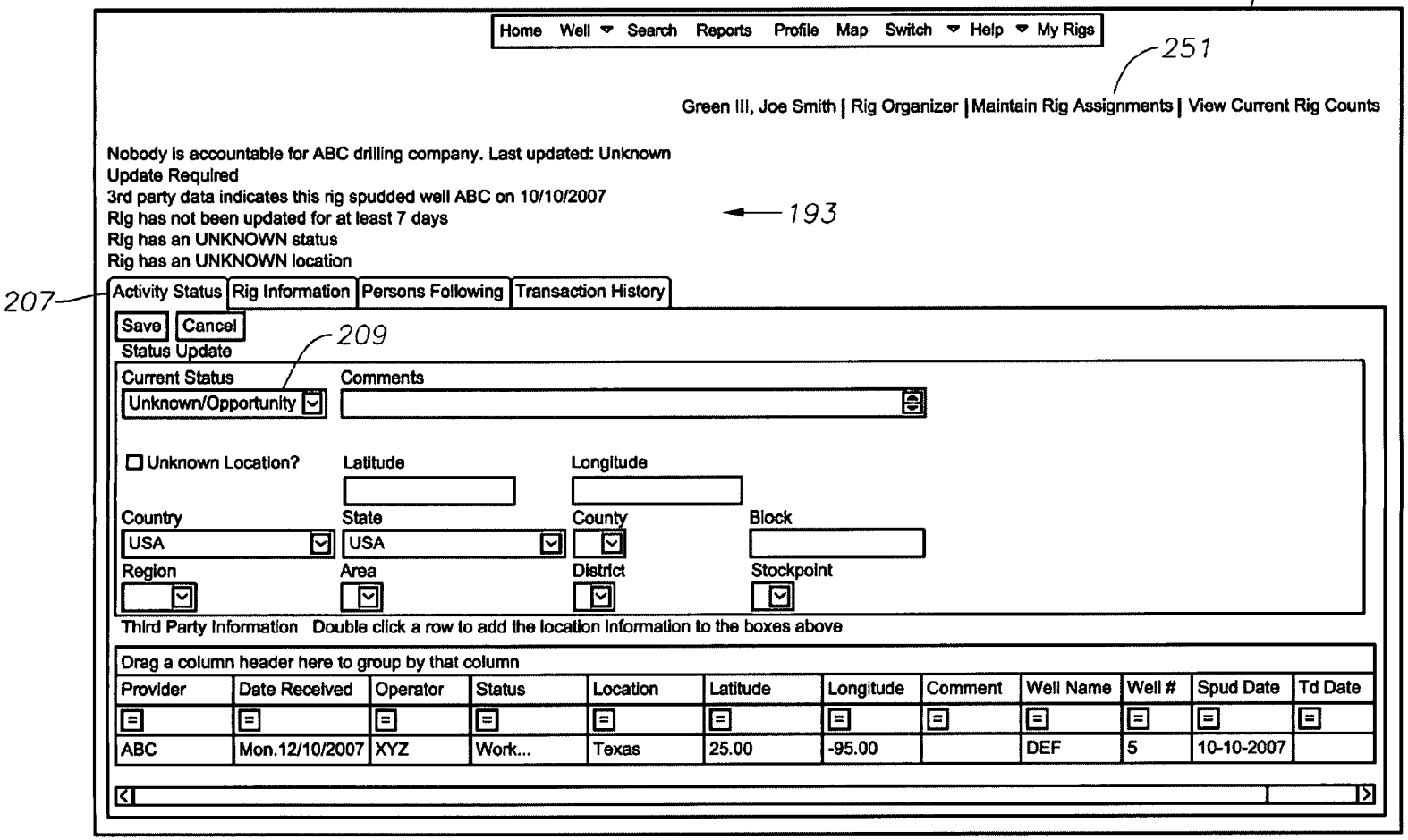
FIG. 21 is a schematic diagram of a rig details webpage according to an embodiment of the present invention.
Figure 23:
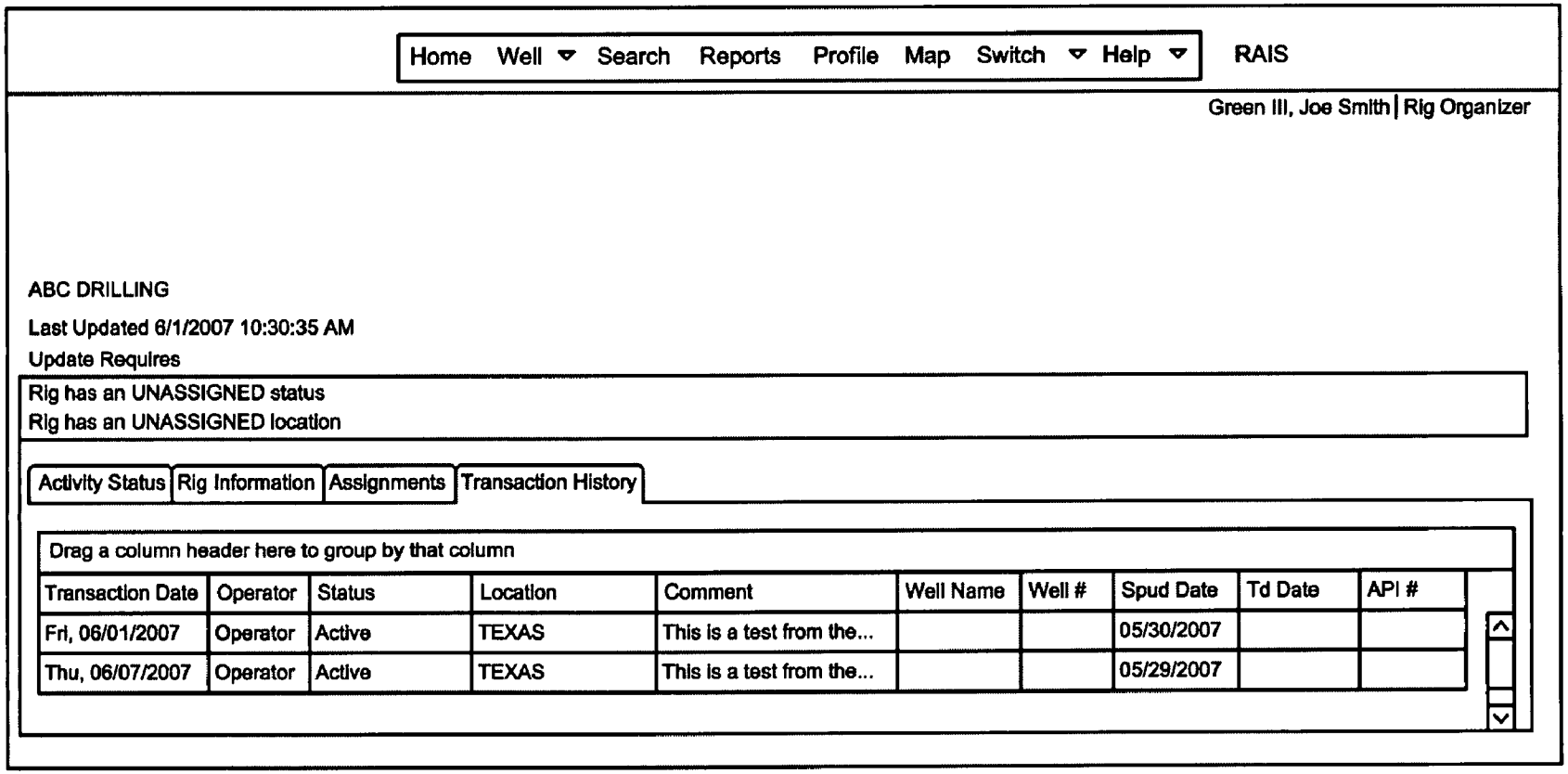
FIG. 23 is a schematic diagram of a webpage including a transaction history table or grid according to an embodiment of the present invention.

As shown in FIGS. 21 and 23, embodiments of the system 20, 20', provide a list of all rig transactions (transaction history) for a specified rig to provide intelligence about rig activity. Notably, such transaction history can be collectively used to provide trend information for not only the specific rig, but categories of rigs, locations, etc. Specifically, according to a preferred configuration, the following transaction history is provided:

Rig Transaction History Field List

| Field | Description |
|---|---|
| Transaction Date | The date of the transaction (converted to users local time). |
| Operator | The operator from the transaction (Active Transactions only). |
| Status | One of the Rig Activity Statuses. |
| Business Unit | The Stockpoint or District where the rig is located. |
| Comment | Description of the transaction. |
| Well Name | Name of the well the rig is drilling (Active Transactions only). |
| Well Number | Number of the well the rig is drilling (Active Transactions only). |
| SPUD Date | Date a well is spuded (Active Transactions only). |

Figure 24:
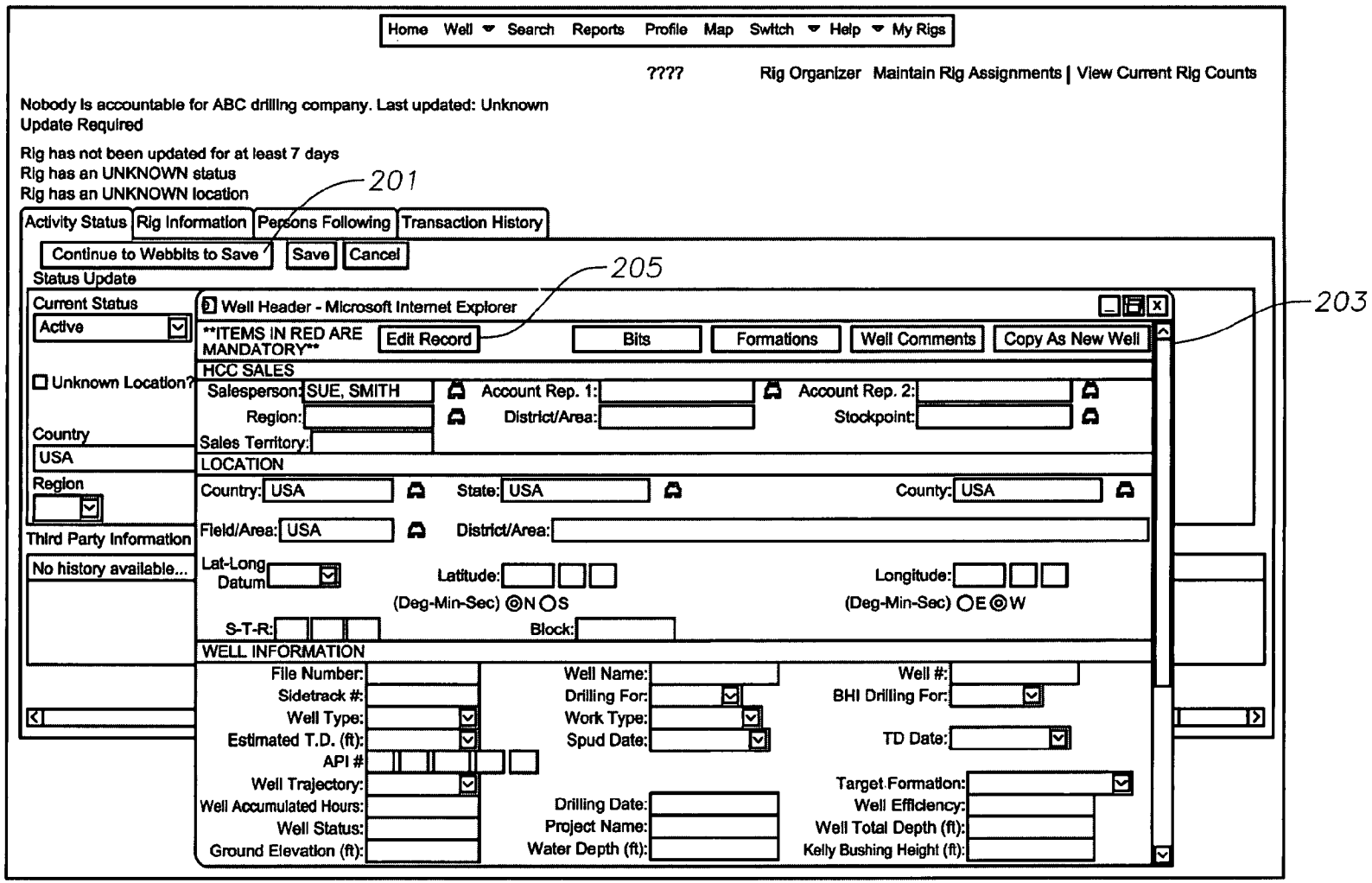
FIG. 24 is a schematic diagram of a webpage including well information selected through a rig details webpage according to an embodiment of the present invention.

As shown in FIGS. 24 and 25, embodiments of the system 20, 20', enable the user to navigate well header information, particularly for a rig having "active drilling" status. For example, according to a preferred configuration, if the rig status is set to "Active Drilling," the user is provided a "Continue to Webbits" button 201 on the rig details page 200 (FIG. 24), which can be selected, for example, to activate a bit management portion of the system, to display a well header records/details screen 203, for example, as shown.

Similarly, when the user is viewing the organizer page 150 (FIG. 20) and wants to see the listing of all wells attached to rigs assigned to him/her, the user can select a specific rig to thereby launch the rig details page 200 (FIGS. 21 and 24). If the rig assigned to that user is associated with a well, then the well record information can be displayed in display screen 203. The well record and displayed well information can include the well identification number, well name, well location, and the bit record. The user can then "click" the bit record field or button 205 in the displayed well record to view the bit record details provided by the bits management portion of the system 20, 20' (e.g., "Webbits"). Note, if there is no well assigned to that rig, the corresponding well record will be blank.

Referring again to FIG. 21, embodiments of the present invention allow a user to update the activity status of a selected rig according to the below describes steps.

Step #1—Set Current Status. To set current status having selected rig details via selection of a rig from the list in FIG. 20, and the "activity status" tab 207 if not already selected, the user is presented the fields shown in FIG. 21, for example. Using the current status drop-down box 209, the user selects the current activity status of the rig from one of the following choices: AD for "Active Drilling"; and for "Active Not Drilling"; SSO for "Stacked or Suspended Operation"; UO for "Unassigned/Opportunity"; and M for "Moving." If the user selects the "AD—Active Drilling" option, then the control flow branches from this main scenario to one of the two alternative scenarios, depending on the user participating in the scenario. If any other selection is made, control continues to Step #2, below.

Step #2—Add Compulsory Comments. To add compulsory comments, using a multi-line "Comments" text box, the user enters comments to describe the transaction.

Step #3—Update Optional Location Info. The location information includes both geopolitical and business unit location. The current or latest locations of the rig are displayed to the user using a series of controls enabling the user to either accept or update the current location of the rig. For the geopolitical location, the controls can include the following selection-type (dropdown) controls: "country"; "state/province"; and "county/offshore location." If the location type is set to "offshore," then an additional text box control is visible which contains an optional offshore block attribute that can be manually typed in. For the business unit location, the controls can include the following selection-type (dropdown) controls: "Region"; "Area"; "District"; "Stockpoint"; and "Sales Territory" (normally only visible if the Stockpoint has associated territories). If any of the location levels is not known (such as county, state, stockpoint, etc), then the user may choose an "unknown" selection in that box. If the entire location is not known, then the user should select a check box labeled "unknown," which disables all other rig location controls. The user can select any of the valid geopolitical and business unit locations in the system regardless if he is assigned to them via the territory assignment since he might need to indicate that the rig is moving to a geographical area outside his responsibility.

Step #4—Save the Record. The records can be saved by selecting the save button which creates a new rig transaction object and is saved to the database. The user optionally may choose the "cancel" button, which prompts the user for confirmation and then cancels the operation.

According to an alternative scenario different users are given different permissions. For example, where the user is a Field Rep or Field Ops Manager, all controls defined above are disabled, except, for example, for the "cancel" button. Instead of a "save" button, the user sees a "Continue to WebBits" button 201 (FIG. 24). When clicked, the button directs 201 the user to the Rig Search screen in WebBits (part of the API number search functionality) that attempts to locate an existing well header (or 3rd party well info) for the selected rig.

According to another alternative scenario such as, for example, where the user is a District Controller, Region Controller, or Company Controller, a panel appears below the current status drop down displaying the active drilling transaction criteria fields to be entered. No default values are set. Such user can add/enter data such as, for example, the following active drilling criteria needed for and active transaction to be saved:

Active Drilling Transaction Criteria

| Attribute | Description |
|---|---|
| Day Work | DayWork name lookup. |
| Direction | The directional type name lookup. |
| Est. Total Depth | Estimated total depth in feet. |
| Geographical Location | Contains the latitude, longitude, and elevation. |
| Land Formation | Name of the land formation lookup. |
| Mineral Type | Name of the mineral being drilled for lookup. |

-continued

Active Drilling Transaction Criteria

| Attribute | Description |
|---|---|
| Operator | Name of the operator lookup. |
| Spud Date | Est. date the well was spud-ed. |
| Well Type | The name of the type of well lookup. |

The user then continues on to add compulsory comments as described with respect to "step #2," above. Notably, various other embodiments are within the scope of the present invention.

Figure 26:
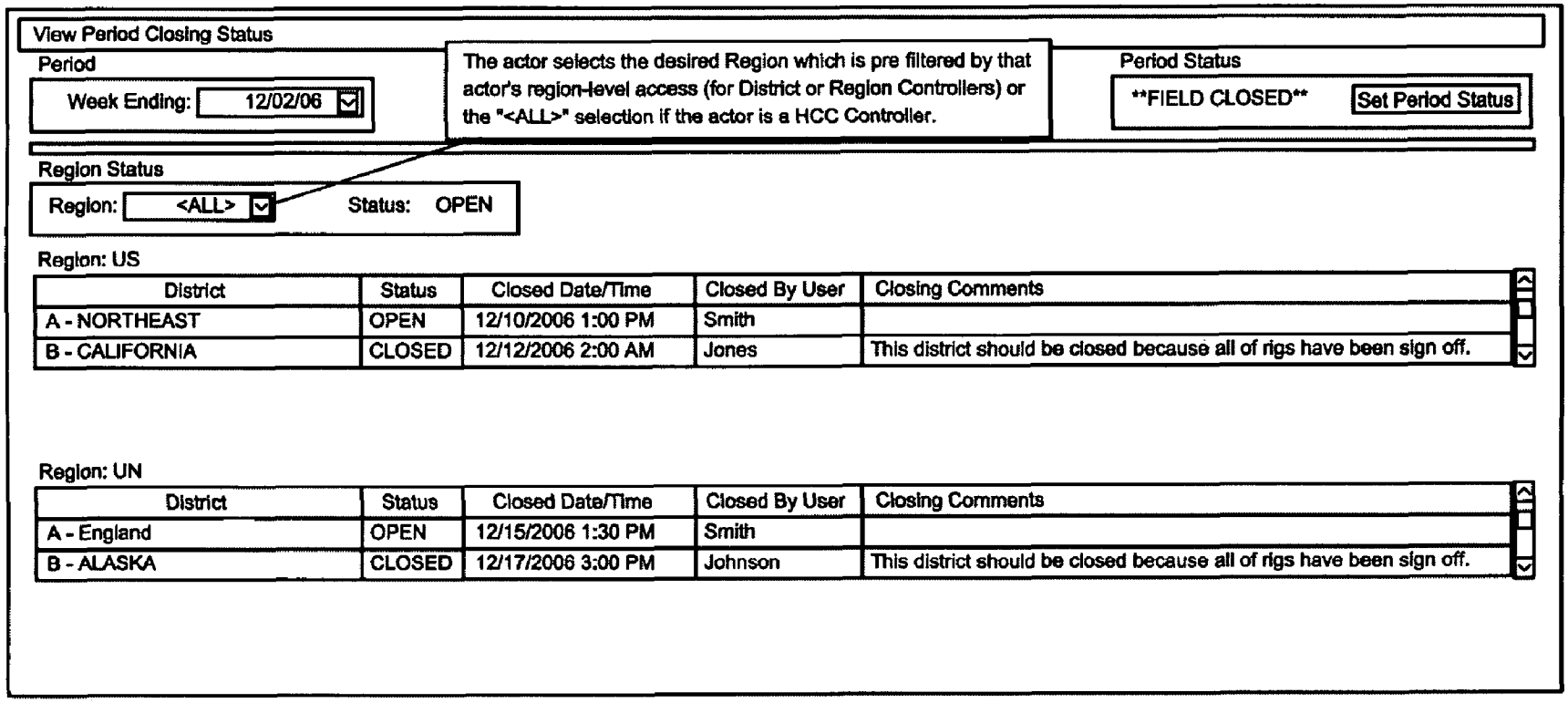
FIG. 26 is a schematic diagram of a webpage illustrating a book closing report according to an embodiment of the present invention.
Figure 27:
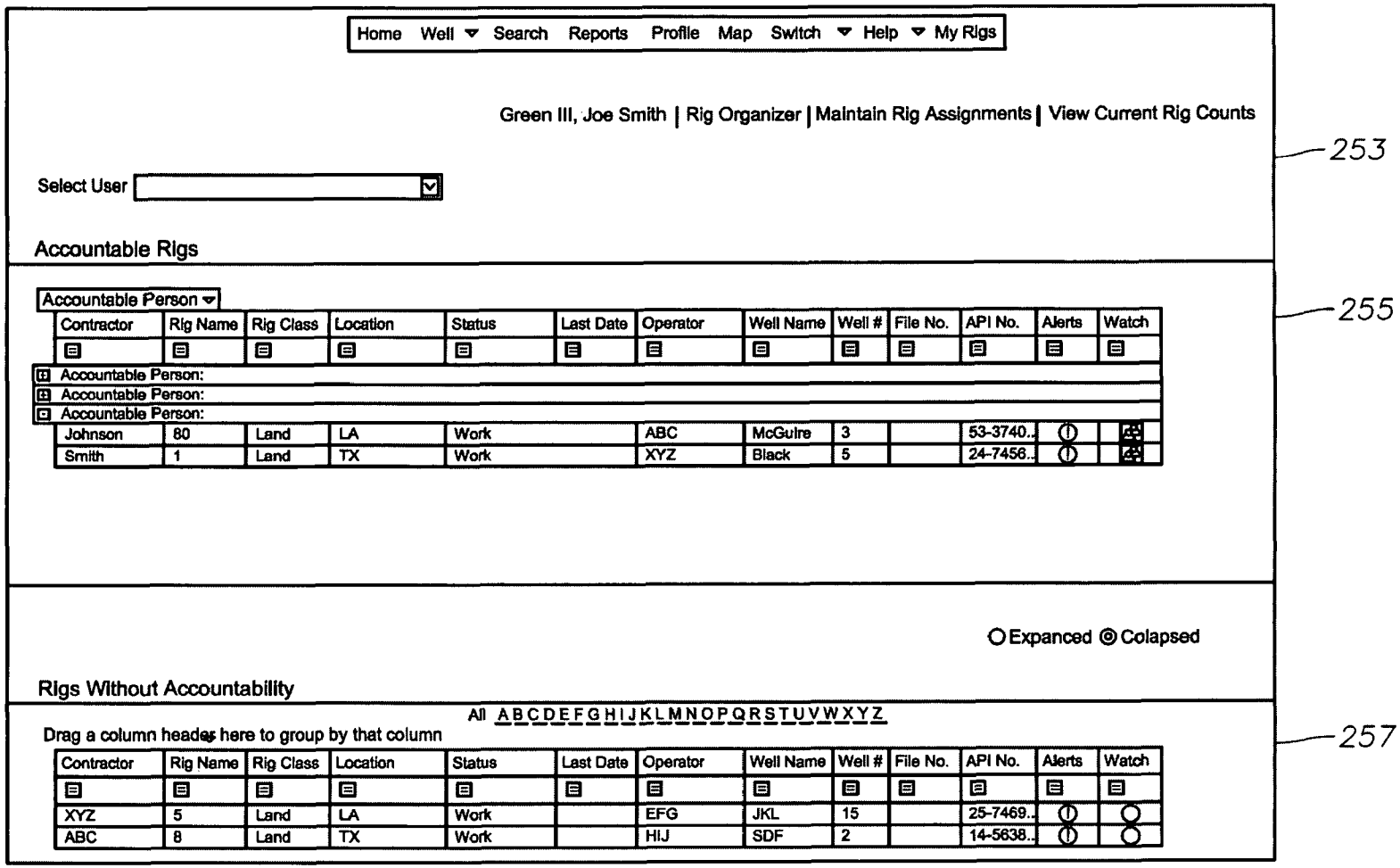
FIG. 27 is a schematic diagram of a webpage illustrating a pair of list boxes or tables used to assign personnel to rigs according to an embodiment of the present invention.

As shown in FIG. 26, users are provided reports such as, for example, various snapshots of data including, e.g., data for validating a rig count for an accounting period as shown in the figure, used to begin the process of "closing books." Such validation can be by location/total and/or for a specified time period. Other reports include, for example, exception reports which can include, e.g., the following information: rigs that have been moving for more than four days (last activity is moving and was made greater than four days ago (configurable)); rigs that have moved but have not been picked up by another user in the new location (i.e., where there are no users within the geographical area assigned to this rig); rigs with no persons assigned to them (e.g., no reps, etc); rigs that are set to unassigned; rigs with no geographical location set, rigs moving with no location set, rigs set to active with missing data, such as, location and/or well type, rig type, mineral type, configuration type, depth, etc; new rigs; and rigs with no designation.

Embodiments of the present invention also enable a user to reconcile all the transactions for a period for the user's assigned business unit(s) and "close the books" for the period in that business unit(s). Specifically, embodiments of the present invention allow the user to view data about the rig count for his responsible business unit and period, make corrections by entering rig transactions, sign off on the required fields, enter closing comments and close the business unit for the period. Applicable portions of the program product are launched via a "View Rig Transactions by Period" screen 210 (FIG. 22). According to a preferred configuration, by default the current period is displayed in field 211. A series of drop down boxes 213, 215, 217, are also displayed allowing the user to select the desired Region, District, and Stock point, respectively. By default, the appropriate region, district and stock point are selected corresponding to the user's role permissions and business unit assignments. For example, a District Controller would have his region and district already chosen with "all" selected for the stock point while a region controller would have his region and "all" selected for the district and stock point whereas the Company Controller would have "all" selected for all three dropdowns. The current status of the period and the business unit is displayed to the user. Period closing states are defined as:

| Event Seq | Event Desc | Detail |
|---|---|---|
| 1 | Field Closed | The period is ready to be reconciled and closed for each of the districts for the period. Field users' transactions are no longer entered into this period but entered into the next period. |
| 2 | District Closed | The period is ready to be reconciled and closed for each of the regions for the period. District controllers can no longer modify records for that period. |

-continued

| Event Seq | Event Desc | Detail |
|---|---|---|
| 3 | Region Closed | The period is ready to be reconciled and closed for the entire corporation. District and Region controllers can no longer modify records for that period. |
| 4 | Period Closed | The location is closed and is read-only. The period can NOT be reopened for that period for editing. |

Business unit states (for a specific period) are defined, for example, as:

| State | Detail |
|---|---|
| Open | The period is ready to be reconciled and closed for each of the districts for the period. Field users' transactions are not entered into this period but entered into the next period. |
| Closed | The period is ready to be reconciled and closed for each of the regions for the period. District Controllers can no longer modify records for that period. |

In order to reconcile and close the period, the user chooses a period/business unit combination that the user has access to and is currently open. After choosing the business and period, the user is presented with two informational lists that show all of the intelligence needed to reconcile and close a business unit for that period—the Period Variance Listing and the Rig Alerts Listing. The user is also presented with a button to "View Closing Comments." When clicked, a new modal window (or popup window) is displayed showing a printer friendly version of each district name, user name, and the comment entered by that user for the district when it was closed, grouped by region. The list is filtered by region so only a single region is shown at a time unless "all" is selected in the region box. Districts that are not closed (and therefore have no comments) are not shown, according to this exemplary configuration.

Period Variance Listing. The period variance section 221 displays a listing of the total count of rigs for the currently selected business unit and period combination grouped by the following criteria:

| Grouping | Description |
|---|---|
| Active Drilling | Total rigs with a current status of "Active Drilling" for the period. |
| Active Not Drilling | Total rigs with a current status of "Active Not Drilling" for the period. |
| Stacked or Suspended Operation | Total rigs with a current status of "Stacked or Suspended Operation" for the period. |
| Moving | Total rigs with a current status of "Moving" for the period. |
| Unassigned/ Opportunity | Total rigs with a current status of "Unassigned/Opportunity" for the period. |
| Move Ins | Total number of rigs that moved in this period. |
| Move Outs | Total number of rigs that moved out this period. |
| Total Rigs | Total number of rigs for the period. |

Each row in the listing, according to this exemplary configuration, shows the user: the value for the: the current period total; the previous period total; the change in the total; and the percent change in the total. If the absolute value of the percent change exceeds a configurable threshold (set at 5% initially), then a visual alert is displayed for that entire row (grouping) using an alternate row color. The user can click on any of the rows, which can then navigate the user to a new screen which displays a list of the rigs in that grouping.

Rig Alerts Listing. The rig alerts section 231 shows a listing of any rigs in the current period-business unit combination that violate one or more of the defined rig exception alerts. The list displays the following fields:

| Field | Description |
|---|---|
| Rig | Contains a concatenation of the Contractor Name and the Rig Name. |
| District | Name of the district in which the rig is located. |
| Stockpoint | Name of the stockpoint the in which the rig is located. |
| Location | Displays the physical or geopolitical location of the rig such as a county or offshore area. |
| Status | Latest Rig Activity Status. |
| Updated | Displays the day of the week and date of the last update like, "Mon, Dec. 04, 2006." |
| Unwatched | Indicates that the rig is not being watched by anyone in its current stockpoint. This field is empty if not in this condition. |
| 30Days | The rig was in an Unassigned/Opportunity status for 30 days or more and now is NOT in an Unassigned/ Opportunity status this period. This field is empty if not in this condition. |
| Newer3PD | The rig has third party data with a newer transaction date than RAIS. This field is empty if not in this condition. |
| StaleDays | Indicates the number of days that have elapsed past the last updated and the required update interval for the rig based on its rig class. This field is empty if not in this condition. |
| Investigated | A checkbox that indicates that someone has marked the rig as being investigated. The user can check this box directly in the grid. This box is automatically cleared by the system when a new transaction is entered for this rig by any controller. |

There is a check box 241 labeled, "Included Rigs with Unknown Locations" that is not checked by default, according to this configuration. When checked, the Rig Alert listing will include all rigs that have an unknown location, which therefore, will contain null values for the District, Stockpoint, and Location columns. The Rig Alerts listing is sortable by any of the fields and also supports record paging with, e.g., twenty rows per page.

After viewing the information for that business unit, it is possible that some of the data needs to be reconciled and updated based on further analysis and communications with field personnel. To do this, the user enters one or more rig activity transactions for a rig. The user would either drill directly into rig information details accessed through the Rig Alerts section 231 of the screen page 210 or by first navigating through "Variance Rig List by Business Unit" from the Period Variance section 221 of the screen page 210 to get to the rig detail. Once viewing rig detail the user would use a "Rig Transaction" screen (not shown) to add rig transactions.

In order for the user to ultimately close the business unit, he/she will sign off on selected items on the lists simply by clicking a check box. The following items on the period variance list are typically required for signoff and do not require any particular order: Move In; Move Outs; Total Rigs; and Any of the remaining activity statuses in which the percent change exceeds the configurable threshold (set, e.g., at 5% initially). While any user defined for this use case may view data, only users that are viewing the business unit that they have access to (by their role and business unit assignment combination) will be able to actually sign-off on this data. Otherwise, the checkboxes are not even visible.

Once all required sign offs have been made, a "Close Business Unit" button becomes enabled. The user clicks this button, which displays an additional modal form (or popup window) requiring the user to enter in compulsory comments for the business unit and period. The screen shows the period, business unit, controller name, closing date and time along with a multi line text box to capture the user's comments which all are stored with the period upon closing. There are "example" comments displayed to assist the controller in what is relevant or requested here. These examples are read from a configuration table or configuration file (to be initially maintained directly in the data source). The user the presses another button on the comment form named "Save" that completes the business unit closing process.

Once the business unit is closed, it is read only and transactions can no longer be entered. This however, does not preclude the next business unit in the rollup (the region for example) from entering transactions for the same rig since the rig is also in this rollup business unit. When the business unit is closed, the "Close Business Unit" button is no longer visible.

As noted previously, and as perhaps best shown in FIG. 27, embodiments of the system allow personal rig assignments. For example, according to one methodology, from the operator screen 150 (FIG. 20), a user selects a checkbox for each associated rig and selects the "follow rig" button 175 to self-assign the selected rig to him/herself, or though "release rig" button 177 to remove the assignment of the selected rigs.

According to another methodology, from the organizer screen 150 (FIG. 20), a Field Operations Manager (FOM) user, for example, selects the "maintain rig assignments" field 251. The resulting screen 253 displays two list boxes or tables 255, 257: The top box or table 255 displays users currently assigned to the rig. The bottom box 257 displays all available personnel with the "Can be assigned to Rig" permission for the business unit(s) that the Field Operation Manager (user performing the assignment) is currently associated to, and which are not already associated with the rig. The Field Operation Manager user can also move rigs between the boxes with navigation buttons either one at a time and/or with multiple selections. As above, such movement of people to or from the account will rigs box or table 255 can beneficially update the assignment to the rig immediately to the database.

Embodiments of the system 20, 20', also provide a search engine function. As shown, for example, in FIG. 20, a user can select the "search" field or hyperlink 261. A resulting search screen (not shown), which can allow the user to search for rigs, e.g., by rig name or number, or to search for operators, contractors, etc.

It is important to note that while embodiments of the present invention have been described in the context of a fully functional system 20, 20', account system 23, and drilling rig information management program product 51, and related methods, those skilled in the art will appreciate that the mechanism of the present invention and/or aspects thereof are capable of being distributed in the form of a computer readable medium storing instructions in a variety of forms for execution on a processor, processors, or the like, and that the present invention applies equally regardless of the particular type of signal bearing media used to actually carry out the distribution. Examples of computer readable media include but are not limited to: nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, flash drives, and other newer types of memories, and transmission type media such as, for example, digital and analog communication links capable of storing the instructions. For example, such media can include both operating instructions and/or instructions related to the systems, program product, or method steps described above.

Embodiments of the present invention have several advantages. For example, Embodiments of the present invention provide drilling rig accounting rather than merely drilling rig counting, and provide an interactive system interfaced with specific rig assignments and a drilling bit management system. Embodiments of the present invention also provide for gathering and compiling procedures from across the world, data verification for the rig information databases, and a resulting standard of compliance worldwide that tracking and eliminate mistakes. As such, embodiments of the system 20, 20', program product 51, and related methods can post rig count data to both the internal system personnel as well as to external users, which go beyond that of traditional "rig counts." Such embodiments can use currently collected and historical rig count information that will be spatialized and presented in maps and will be supplemented by text, tables, spreadsheets, charts, graphs, images, files, photos, audio, or video clips. Users can be presented with GIS browse capabilities as well as selected data export functionality. User can also be able to produce maps of rig locations with reference to other spatial features. Queries may be generated that have a spatial output component as well as the traditional tabular outputs. Export from the system 20, 20', can include text, tables, spreadsheets, charts, images, photos, maps, files, graphs, or audio or video clips. In addition to the before mentioned capabilities, the embodiments of the present invention can be used to track a variety of other drilling related activities. Other categories include, for example, the tracking and reporting of the wireline logging units, pumping units, or other equipment involved in the lifecycle of an oil, gas, or geothermal well.

This application is related to and claims priority to and the benefit of U.S. Provisional Patent No. 60/875,442, by Arango et al., titled "System and Method for Drilling Rig Activity Accounting and Visualization" incorporated by reference herein in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, the exemplary embodiments of the present invention were primarily directed to vessels. One skilled in the art would recognize the applicability to land and aerial vehicles.

That claim is:

1. A system to monitor drilling rig activity and to provide and manage drilling rig information, the system comprising:

a communication network;

at least one computer defining a drilling rig information management server positioned at a data center in communication with the communication network to provide user access to drilling rig information, the drilling rig information management server including a processor and memory in communication with the processor;

a rig information database accessible to the processor of the drilling rig information management server and including drilling rig activity data containing drilling rig location data for drilling rigs; and drilling rig information management program product stored in the memory of the drilling rig information management server and including instructions that when executed by the processor of the drilling rig information management server cause the server to perform the operations of:

retrieving drilling rig location data from the database responsive to user selection of a geospatial location attribute comprising one or more of the following: a geological province and a geological basin, accessing digital mapping data to display a digital map of at least portions of a geospatial location defined by the geospatial location attribute responsive to the user selected geospatial location attribute, and providing data to display indicia of a drilling rig location for each of a plurality of drilling rigs associated with the geospatial location defined by the geospatial location attribute overlaid upon and spatially oriented to the at least portions of the digital map.

2. The system as defined in claim 1, wherein the system further comprises a plurality of user communication devices each positioned remote from the drilling rig information management server and having access to the communication network and having a processor, memory coupled to the processor to store operating instructions therein and to receive drilling rig activity data and digital mapping data, a user display in communication with the processor of the user communication device to display indicia of a drilling rig location overlaid upon and spatially oriented to at least portions of a displayed digital map, and a user interface in communication with the processor of the user communication device to provide each of a corresponding plurality of users with online access to the drilling rig activity data over the communication network to thereby view the drilling rig location for each of the plurality of drilling rigs; and wherein the indicia of a drilling rig location is provided for each of the plurality of drilling rigs associated with at least the geospatial location defined by the geospatial location attribute in association with portions of the digital map thereof displayed on the user display of a respective user communication device.

3. The system as defined in claim 1, wherein the drilling rig information management program product further includes instructions that when executed by the processor of the drilling rig information management server, cause the server to further perform the operation of:

providing time-sequenced drilling rig activity evolution data to graphically display a time-sequenced evolution of a drilling rig activity for a preselected area over a preselected period of time defining an extent of the time-sequenced evolution, at least a portion of the time-sequenced drilling rig activity evolution graphically overlaid upon and spatially oriented to the at least portions of the geospatial location defined by the geospatial location attribute and describing time-sequenced drilling rig physical location movement in relation to the geospatial location.

4. The system as defined in claim 1, wherein the drilling rig information management program product further includes instructions that when executed by the processor of the drilling rig information management server, cause the server to further perform the operation of providing time-sequenced drilling rig activity evolution data to graphically display a time-sequenced evolution of a drilling rig activity over a preselected period of time for a preselected area; and wherein the time-sequenced drilling rig activity evolution data includes at least one of the following each separately selectable by a user:

drilling rig location data describing drilling rig physical location movement into or out of the preselected area, drilling rig monetary investment data describing investment progression into or out of the preselected area, drilling rig asset data describing drilling rig asset movement into or out of the preselected area, and personnel data describing movement of drilling rig-associated personnel into or out of the preselected area.

5. The system as defined in claim 1, wherein the drilling rig information management program product further comprises:

a data receiver adapted to receive data supplied in a database entry form and entered through a user interface;

a queue adapted to receive third party drilling rig attribute or activity data for data validation review;

a rig activity status displayer adapted to provide data to display rig activity status for a user selected drilling rig on a user interface;

a rig attribute displayer adapted to provide data to display rig attributes for a user selected drilling rig on a user interface;

a rig transaction history displayer adapted to provide data to display rig transaction history for a selected one or more drilling rigs or projects;

a rig activity status recorder adapted to receive data for updating rig activity;

a rig attribute recorder adapted to receive data for updating rig attributes;

a digital map interface adapted to retrieve digital mapping data for the geospatial location defined by the geospatial location attribute responsive to user selection of the geospatial location attribute; and a location localizer adapted to spatially orient a selected drilling rig or drilling rigs or projects with a selected portion of a digital mapping environment defined by the geospatial location attribute responsive to user selection of the geospatial location attribute for display to a respective user interface.

6. The system as defined in claim 1, wherein the drilling rig information management program product further includes instructions that when executed by the processor of the drilling rig information management server, cause the server to further perform the operations of:

receiving drilling rig activity data from a source other than an internal or external trusted source defining third party drilling rig activity data, the data entered into a standardized Web browser readable data entry form;

queuing the received third party drilling rig activity data for data validation review;

sending an electronic message to a field representative requesting performance of visual on-site verification of the third party drilling rig activity data responsive to the third party drilling rig activity data held in the queue;

receiving indicia of physical verification of the received third party drilling rig activity data from the field representative defining a data verification acknowledgment;

releasing the third party drilling rig activity data from the queue responsive to receipt of the data verification acknowledgment; and storing the third party drilling rig activity data in the rig information database.

7. The system as defined in claim 6, wherein the operations further comprise:

receiving drilling rig activity data from a plurality of internal users to define internally supplied drilling rig activity data, the data entered into a standardized Web browser readable database entry form; and storing the internally supplied drilling rig activity data in a rig information database responsive to receiving the drilling rig activity data from the plurality of internal users, the operation of storing performed without processing through a queue or performing an additional data verification acknowledgment.

8. The system as defined in claim 6, wherein the operations further comprise:

estimating a level of uncertainty in the received third party drilling rig activity data, the level of uncertainty resulting from noise comprising one or more of the following: inaccurate drilling rig activity observation data, unverified drilling rig activity data, and unverified drilling rig attribute data.

9. The system as defined in claim 1, wherein the drilling rig information management program product further includes instructions that when executed by the processor of the drilling rig information management server, cause the server to further perform the operations of:

receiving data indicating movement of a drilling rig defining a moving drilling rig from a first location within a territory assigned a first user without specification of a destination location;

creating a record assigning the moving drilling rig no location value in a location field;

providing an unknown location filter that returns a list of all rigs that have no location of value assigned to thereby provide an accounting placeholder for the moving drilling rig;

receiving data indicating discovery of a physical arrival of the moving drilling rig at a second location within a territory assigned a second user; and assigning the moving drilling rig to the second user responsive to the data indicating the discovered physical arrival.

10. A method of monitoring drilling rig activity and providing and managing drilling rig information, the method comprising the steps of:

receiving drilling rig location data from a database responsive to user selection of a geospatial location attribute;

accessing digital mapping data to display a digital map of at least portions of a geospatial location defined by the geospatial location attribute responsive to user selection of the geospatial location attribute; and providing data to display indicia of drilling rig activity for each of a plurality of drilling rigs associated with the geospatial location defined by the geospatial location attribute overlaid upon and spatially oriented to at least portions of the digital map: wherein the steps of receiving, accessing and providing are performed by one or more computers programmed to perform said steps.

11. The method as defined in claim 10, wherein the geospatial location attribute comprises a geological province or basin; and wherein the indicia of drilling rig activity includes present location for each of the plurality of drilling rigs within the confines of the geospatial location defined by the geospatial location attribute in association with at least portions of the digital map thereof provided for display on a user display of a respective user communication device responsive to the user selection of the geospatial location attribute.

12. The method as defined in claim 10, wherein the step of providing data to display indicia of drilling rig activity comprises the step of:

providing time-sequenced drilling rig activity evolution data to graphically display a time-sequenced evolution of drilling rig activity for a preselected period of time defining a time-sequenced evolution of transaction history, at least a portion of the time-sequenced drilling rig activity evolution graphically overlaid upon and spatially oriented to at least portions of the geospatial location defined by the geospatial location attribute and describing time-sequenced drilling rig activity movement in relation to the geospatial location.

13. The method as defined in claim 10, wherein the step of providing data to display indicia of drilling rig activity comprises the step of:

providing time-sequenced drilling rig activity evolution data to graphically display a time-sequenced evolution of a drilling rig activity over a preselected period of time for a preselected area; and wherein the time-sequenced evolution of a drilling rig activity includes at least one of the following each separately selectable selected by a user:

drilling rig physical location movement into or out of a preselected area, investment progression into or out of the preselected area, drilling rig asset movement into or out of the preselected area, and movement in personnel into or out of the preselected region, or a combination thereof.

14. The method as defined in claim 10, the method further comprising the steps of:

receiving drilling rig activity data from a source other than an internal or external trusted source defining third party drilling rig activity data, the data entered into a standardized Web browser readable data entry form;

queuing the received third party drilling rig activity data for data validation review;

sending an electronic message to a field representative requesting performance of visual on-site verification of the third party drilling rig activity data responsive to the third party drilling rig activity data held in the queue;

receiving indicia of physical verification of the received third party drilling rig activity data from the field representative defining a data verification acknowledgment;

releasing the third party drilling rig activity data from the queue responsive to receipt of the data verification acknowledgment; and storing the third party drilling rig activity data in a rig information database.

15. The method as defined in claim 14, the method further comprising the steps of:

receiving drilling rig activity data from a plurality of internal users to define internally supplied drilling rig activity data, the data entered into a standardized Web browser readable database entry form; and storing the internally supplied drilling rig activity data in the rig information database responsive to receiving the drilling rig activity data from the plurality of internal users, the operation of storing performed without processing through a queue or performing an additional data verification acknowledgment.

16. The method as defined in claim 15, the method further comprising the step of:

estimating a level of uncertainty in the received third party drilling rig activity data, the level of uncertainty resulting from noise comprising one or more of the following: inaccurate drilling rig activity observation data, unverified drilling rig activity data, and unverified drilling rig attribute data.

17. A non-transitory computer readable medium to monitor drilling rig activity and to provide and manage drilling rig information, the computer readable medium comprising a set of instructions that, when executed by a computer, cause the computer to perform the operations of:

receiving drilling rig location data from a database responsive to user selection of a geospatial location attribute accessing digital mapping data to display a digital map of at least portions of a geospatial location defined by the geospatial location attribute responsive to user selection of the geospatial location attribute; and providing data to display indicia of a drilling rig activity for each of a plurality of drilling rigs associated with the geospatial location defined by the geospatial location attribute overlaid upon and spatially oriented to at least portions of the digital map.

18. The non-transitory computer readable medium as defined in claim 17, wherein the geospatial location attribute comprises a geological province or basin; and wherein the indicia of a drilling rig activity includes present location for each of the plurality of drilling rigs associated with the geospatial location defined by the geospatial location attribute in association with at least portions of the digital map thereof is provided for display on the user display of a respective user communication device responsive to the user selection of the geospatial location attribute.

19. The non-transitory computer readable medium as defined in claim 17, wherein the operation of providing data to display indicia of drilling rig activity comprises:

providing time-sequenced drilling rig activity evolution data to graphically display a time-sequenced evolution of a drilling rig activity for a preselected period of time defining a time-sequenced evolution of transaction history, at least a portion of the time-sequenced drilling rig activity evolution graphically overlaid upon and spatially oriented to at least portions of the geospatial location defined by the geospatial location attribute and describing time-sequenced drilling rig physical location movement in relation to the geospatial location.

20. The non-transitory computer readable medium as defined in claim 17, wherein the operation of providing data to display indicia of drilling rig activity comprises:

providing time-sequenced drilling rig activity evolution data to graphically display a time-sequenced evolution of a drilling rig activity over a preselected period of time for a preselected area; and wherein the time-sequenced drilling rig activity evolution data includes at least one of the following each separately selectable by a user:

drilling rig location data describing drilling rig physical location movement into or out of the preselected area, drilling rig monetary investment data describing investment progression into or out of the preselected area, drilling rig asset data describing drilling rig asset movement into or out of the preselected area, and personnel data describing movement of drilling rig-associated personnel into or out of the preselected area.

21. The non-transitory computer readable medium as defined in claim 17, the operations further comprising:

receiving drilling rig activity data from a source other than an internal or external trusted source defining third party drilling rig activity data, the data entered into a standardized Web browser readable data entry form;

queuing the received third party drilling rig activity data for data validation review;

sending an electronic message to a field representative requesting performance of visual on-site verification of the third party drilling rig activity data responsive to the third party drilling rig activity data held in the queue;

receiving indicia of physical verification of the received third party drilling rig activity data from the field representative defining a data verification acknowledgment; and storing the third party drilling rig activity data in a rig information database.

22. The non-transitory computer readable medium as defined in claim 21, the operations further comprising:

receiving drilling rig activity data from a plurality of internal users to define internally supplied drilling rig activity data, the data entered into a standardized Web browser readable database entry form; and storing the internally supplied drilling rig activity data in the rig information database responsive to receiving the drilling rig activity data from the plurality of internal users, the operation or storing performed without processing through a queue or performing an additional data verification acknowledgment.

23. The non-transitory computer readable medium as defined in claim 17, the operations further comprising estimating a level of uncertainty in the received third party drilling rig activity data, the level of uncertainty resulting from noise comprising one or more of the following: inaccurate drilling rig activity observation data, unverified drilling rig activity data, and unverified drilling rig attribute data.

24. A system to monitor drilling rig activity and to provide and manage drilling rig information, the system comprising:

a drilling rig information management server to provide user access to drilling rig information, the drilling rig information management server including a processor and memory in communication with the processor; and drilling rig information management program product stored in the memory of the drilling rig information management server and including instructions that when executed by the server cause the server to perform the operations of:

retrieving drilling rig location data from a database responsive to user selection of a geospatial location defined by a geospatial location attribute, accessing digital mapping data to display a digital map of at least portions of a geospatial location defined by the geospatial location attribute responsive to the user selected geospatial location attribute, and providing time-sequenced drilling rig activity evolution data to graphically display a time-sequenced evolution of a drilling rig activity for the geospatial location over a preselected period of time defining an extent of the time-sequenced evolution, at least a portion of the time-sequenced drilling rig activity evolution data graphically overlaid upon and spatially oriented to at least portions of the digital map of the geospatial location and describing time-sequenced drilling rig activity in relation to the geospatial location.

25. The system as defined in claim 24, wherein the time-sequenced drilling rig activity evolution data includes at least one of the following each separately selectable by a user:

drilling rig location data describing drilling rig physical location movement into or out of the geospatial location;

drilling rig monetary investment data describing investment progression into or out of the geospatial location;

drilling rig asset data describing drilling rig asset movement into or out of the geospatial location; and personnel data describing movement of drilling rig-associated personnel into or out of the geospatial location.

26. The system as defined in claim 24, wherein the geospatial location comprises any user selected one of either of the following:

an area defined by economic attributes;

an area defined by geological attributes;

an area defined by geographical attributes;

an area defined by political attributes; and an area defined by cultural attributes.

* * * * *